United States Patent [19]

Ichigaya

[11] 4,416,180

[45] Nov. 22, 1983

[54] WAVE SYNTHESIZING APPARATUS

[75] Inventor: Hiroshi Ichigaya, Saitamo, Japan

[73] Assignee: Sony Corporation, Tokyo, Japan

[21] Appl. No.: 419,524

[22] Filed: Sep. 17, 1982

Related U.S. Application Data

[63] Continuation of Ser. No. 180,457, Aug. 22, 1980, abandoned.

[30] Foreign Application Priority Data

Aug. 24, 1979 [JP] Japan ..... 54-107823

[51] Int. Cl.[3] ..... G10H 1/06

[52] U.S. Cl. ..... 84/1.23; 84/1.01

[58] Field of Search ..... 84/1.01, 1.03, 1.19, 84/1.21, 1.22, 1.23; 364/718, 721

[56] References Cited

U.S. PATENT DOCUMENTS

| | | | |
|---|---|---|---|
| 3,888,153 | 6/1975 | Deutsch | 84/1.01 |
| 4,215,614 | 8/1980 | Chibana | 84/1.22 |
| 4,238,984 | 12/1980 | Watanabe | 84/1.01 |
| 4,256,004 | 3/1981 | Takeuchi | 84/1.21 |
| 4,262,573 | 4/1981 | Chibana | 84/1.01 |
| 4,279,186 | 7/1981 | Deforeit | 84/1.01 |

*Primary Examiner*—F. W. Isen

*Attorney, Agent, or Firm*—Hill, Van Santen, Steadman & Simpson

[57] ABSTRACT

A waveform synthesizing apparatus is provided for producing a desired synthesized waveform by adding partial waveforms together. In this apparatus, the times within a cycle wherein a fundamental and harmonics of a desired wave to be output are stored in the circuitry. Peak values of each partial waveform are formed at the prestored times and output at frequencies, which correspond to or exceed sampling frequencies required by each partial waveform. These partial outputs are fed to low pass filters. Each filter has a cut-off frequency component corresponding to each of the output frequencies to remove therefrom clock components. Outputs of the low-pass filters are added together to obtain a synthesized waveform.

27 Claims, 26 Drawing Figures

Cycle Time =6.4msec
5msec(=1/200Hz)
Period of Fundamental
360°
θ1
θ2
θ3
Time
Group Time =0.8msec
Row Time =50μsec
Key Time =6.25μsec
Column Time =0.78125μsec
Phase Angle of Fundamental
Phase Angle of First Harmonic
Phase Angle of Second Harmonic
8 Group Times/Cycle
16 Row Times/Group Time
8 Key Times/Row Time
8 Column Times/Key Time

FIG. 3

| Group Times C4 \ Key Times C2 | | 0 | 1 | 2 | 3 | 4 | 5 | 6 | 7 |
|---|---|---|---|---|---|---|---|---|---|
| | | 000 | 001 | 010 | 011 | 100 | 101 | 110 | 111 |
| 0 | 000 | | | | | | | | |
| 1 | 001 | | | | | | | | |
| 2 | 010 | | | | | | | | |
| 3 | 011 | | | | | | | | |
| 4 | 100 | | | | | | | | |
| 5 | 101 | | | | | | | | |
| 6 | 110 | | | | | | | | |
| 7 | 111 | | | | | | | | |

MSB LSB

FIG. 4

| Row Times C3 \ Column Times C1 | | 0 | 1 | 2 | 3 | 4 | 5 | 6 | 7 |
|---|---|---|---|---|---|---|---|---|---|
| | | 000 | 001 | 010 | 011 | 100 | 101 | 110 | 111 |
| 0 | 0000 | S/3 | S/6 | S/10 | S/12 | S/14 | S/16 | S/18 | S/20 |
| 1 | 0001 | E | S/7 | S/11 | S/13 | S/15 | S/17 | S/19 | S/21 |
| 2 | 0010 | S/4 | S/8 | N | S/12 | S/14 | S/16 | S/18 | S/20 |
| 3 | 0011 | V | S/9 | S/½ | S/13 | S/15 | S/17 | S/19 | S/21 |
| 4 | 0100 | S/5 | S/6 | S/10 | S/12 | S/14 | S/16 | S/18 | S/20 |
| 5 | 0101 | T | S/7 | S/11 | S/13 | S/15 | S/17 | S/19 | S/21 |
| 6 | 0110 | S/1 | S/8 | S/⅓ | S/12 | S/14 | S/16 | S/18 | S/20 |
| 7 | 0111 | S/□ | S/9 | S/△ | S/13 | S/15 | S/17 | S/19 | S/21 |
| 8 | 1000 | S/3 | S/6 | S/10 | S/12 | S/14 | S/16 | S/18 | S/20 |
| 9 | 1001 | P | S/7 | S/11 | S/13 | S/15 | S/17 | S/19 | S/21 |
| 10 | 1010 | S/4 | S/8 | N | S/12 | S/14 | S/16 | S/18 | S/20 |
| 11 | 1011 | P | S/9 | S/¼ | S/13 | S/15 | S/17 | S/19 | S/21 |
| 12 | 1100 | S/5 | S/6 | S/10 | S/12 | S/14 | S/16 | S/18 | S/20 |
| 13 | 1101 | P | S/7 | S/11 | S/13 | S/15 | S/17 | S/19 | S/21 |
| 14 | 1110 | S/2 | S/8 | S/⅕ | S/12 | S/14 | S/16 | S/18 | S/20 |
| 15 | 1111 | P | S/9 | S/△ | S/13 | S/15 | S/17 | S/19 | S/21 |

MSB LSB

FIG. 5

800Hz Fundamental

| Row Times C3 | Column Times C1 | 0 (000) | 1 (001) | 2 (010) | 3 (011) | 4 (100) | 5 (101) | 6 (110) | 7 (111) |
|---|---|---|---|---|---|---|---|---|---|
| 0 | 0000 | S/2 | S/3 | S/4 | S/6 | S/7 | S/8 | S/9 | S/10 |
| 1 | 0001 | E | N | S/5 | S/6 | S/7 | S/8 | S/9 | S/10 |
| 2 | 0010 | S/1 | S/3 | S/4 | S/6 | S/7 | S/8 | S/9 | S/10 |
| 3 | 0011 | V | S/1/3 | S/5 | S/6 | S/7 | S/8 | S/9 | S/10 |
| 4 | 0100 | S/2 | S/3 | S/4 | S/6 | S/7 | S/8 | S/9 | S/10 |
| 5 | 0101 | T | S/1/4 | S/5 | S/6 | S/7 | S/8 | S/9 | S/10 |
| 6 | 0110 | S/1/2 | S/3 | S/4 | S/6 | S/7 | S/8 | S/9 | S/10 |
| 7 | 0111 | S/□ | S/Δ | S/5 | S/6 | S/7 | S/8 | S/9 | S/10 |
| 8 | 1000 | S/2 | S/3 | S/4 | S/6 | S/7 | S/8 | S/9 | S/10 |
| 9 | 1001 | P | N | S/5 | S/6 | S/7 | S/8 | S/9 | S/10 |
| 10 | 1010 | S/1 | S/3 | S/4 | S/6 | S/7 | S/8 | S/9 | S/10 |
| 11 | 1011 | P | S/1/5 | S/5 | S/6 | S/7 | S/8 | S/9 | S/10 |
| 12 | 1100 | S/2 | S/3 | S/4 | S/6 | S/7 | S/8 | S/9 | S/10 |
| 13 | 1101 | P | S/1/6 | S/5 | S/6 | S/7 | S/8 | S/9 | S/10 |
| 14 | 1110 | S/1/3 | S/3 | S/4 | S/6 | S/7 | S/8 | S/9 | S/10 |
| 15 | 1111 | P | S/Δ | S/5 | S/6 | S/7 | S/8 | S/9 | S/10 |

MSB LSB

MSB LSB

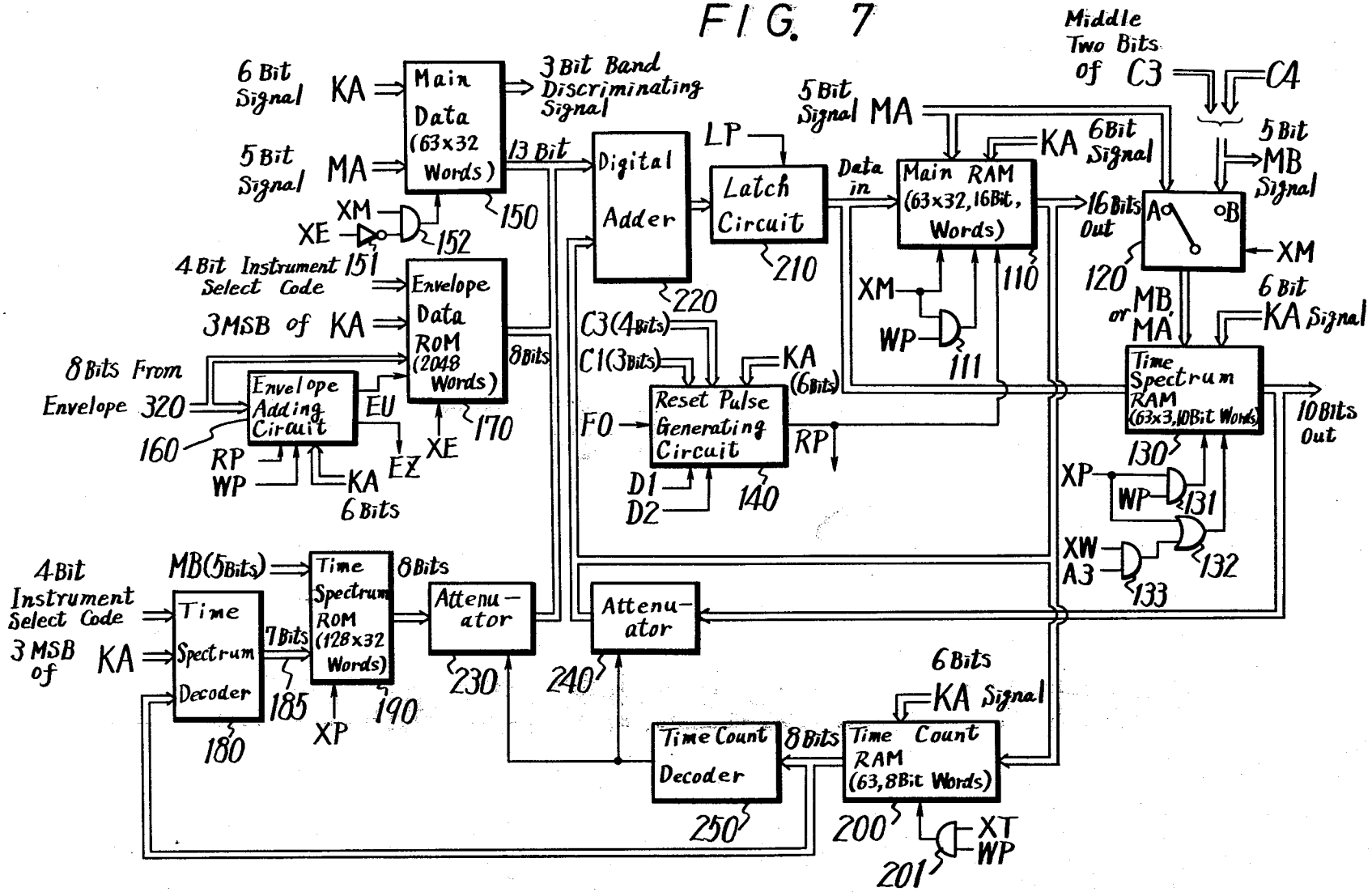
FIG. 7
Middle Two Bits of C3
C4
5 Bit MB Signal
XM
6 Bit KA Signal
10 Bits Out
Time Spectrum RAM (63x3, 10Bit Words)
130
131
132
133
WP
XP
XW
A3
MB or MA
120
16 Bits Out
6 Bit Signal
KA
Main RAM (63x32, 16Bit, Words)
110
111
XM
WP
MA
5 Bit Signal
Data in
Latch Circuit
210
LP
3 Bit Band Discriminating Signal
Digital Adder
220
13 Bit
Main Data (63x32 Words)
150
152
6 Bit Signal
KA
5 Bit Signal
MA
XM
XE
4 Bit Instrument Select Code
151
Envelope Data ROM (2048 Words)
170
8 Bits
XE
EZ
3 MSB of KA
EU
Envelope Adding Circuit
160
RP
WP
6 Bits
8 Bits From Envelope
320
Reset Pulse Generating Circuit
140
KA (6 Bits)
RP
C3 (4 Bits)
C1 (3 Bits)
F0
D1
D2
Attenuator
240
Attenuator
230
8 Bits
Time Spectrum ROM (128x32 Words)
190
XP
17 Bits
185
MB (5 Bits)
Time Spectrum Decoder
180
4 Bit Instrument Select Code
3 MSB of KA
6 Bits
KA Signal
Time Count RAM (63, 8Bit Words)
200
XT
WP
201
8 Bits
Time Count Decoder
250

FIG. 12 110

| 16 Bits (MA Signal) | |
|---|---|
| E | 00000 |
| V | 00001 |
| T | 00010 |
| N | 00011 |
| S 1/5 | 00100 |
| S 1/4 | 00101 |
| S 1/3 | 00110 |
| S 1/2 | 00111 |
| S 1 | 01000 |
| S 2 | 01001 |
| S 3 | 01010 |
| S □ | 01011 |
| S 4 | 01100 |
| S 5 | 01101 |
| S 6 | 01110 |
| S 7 | 01111 |
| S 8 | 10000 |
| S △ | 10001 |
| S 9 | 10010 |
| S 10 | 10011 |
| S 11 | 10100 |
| S 12 | 10101 |
| S 13 | 10110 |
| S 14 | 10111 |
| S 15 | 11000 |
| S 16 | 11001 |
| S 17 | 11010 |
| S 18 | 11011 |
| S 19 | 11100 |
| S 20 | 11101 |
| S 21 | 11110 |
| | 11111 |

32 Words

MSB LSB

FIG. 13 150

| Data (13 Bits) | 3 Bits (MA Signal) | |
|---|---|---|
| | | 00000 |
| V | | 00001 |
| T | | 00010 |
| N | 001 | 00011 |
| S 1/5 | 000 | 00100 |
| S 1/4 | 000 | 00101 |
| S 1/3 | 000 | 00110 |
| S 1/2 | 000 | 00111 |
| S 1 | 000 | 01000 |
| S 2 | 000 | 01001 |
| S 3 | 001 | 01010 |
| S □ | 001 | 01011 |
| S 4 | 001 | 01100 |
| S 5 | 001 | 01101 |
| S 6 | 010 | 01110 |
| S 7 | 010 | 01111 |
| S 8 | 010 | 10000 |
| S △ | 010 | 10001 |
| S 9 | 010 | 10010 |
| S 10 | 010 | 10011 |
| S 11 | 010 | 10100 |
| S 12 | 011 | 10101 |
| S 13 | 011 | 10110 |
| S 14 | 011 | 10111 |
| S 15 | 011 | 11000 |
| S 16 | 011 | 11001 |
| S 17 | 011 | 11010 |
| S 18 | 011 | 11011 |
| S 19 | 011 | 11100 |
| S 20 | 011 | 11101 |
| S 21 | 011 | 11110 |
| | | 11111 |

32 Words

MSB LSB

FIG. 18

| Group | C4 | Row | C3 | MB |
|---|---|---|---|---|
| 0 | 0 0 0 | 9 | 1 0 0 1 | 0 0 0 0 0 |
| 0 | 0 0 0 | 11 | 1 0 1 1 | 0 0 0 0 1 |
| 0 | 0 0 0 | 13 | 1 1 0 1 | 0 0 0 1 0 |
| 0 | 0 0 0 | 15 | 1 1 1 1 | 0 0 0 1 1 |
| 1 | 0 0 1 | 9 | 1 0 0 1 | 0 0 1 0 0 |
| 1 | 0 0 1 | 11 | 1 0 1 1 | 0 0 1 0 1 |
| 1 | 0 0 1 | 13 | 1 1 0 1 | 0 0 1 1 0 |
| 1 | 0 0 1 | 15 | 1 1 1 1 | 0 0 1 1 1 |
| 2 | 0 1 0 | 9 | 1 0 0 1 | 0 1 0 0 0 |
| | | | | |
| 5 | 1 0 1 | 15 | 1 1 1 1 | 1 0 1 1 1 |
| 6 | 1 1 0 | 9 | 1 0 0 1 | 1 1 0 0 0 |
| 6 | 1 1 0 | 11 | 1 0 1 1 | 1 1 0 0 1 |
| 6 | 1 1 0 | 13 | 1 1 0 1 | 1 1 0 1 0 |
| 6 | 1 1 0 | 15 | 1 1 1 1 | 1 1 0 1 1 |
| 7 | 1 1 1 | 9 | 1 0 0 1 | 1 1 1 0 0 |
| 7 | 1 1 1 | 11 | 1 0 1 1 | 1 1 1 0 1 |
| 7 | 1 1 1 | 13 | 1 1 0 1 | 1 1 1 1 0 |
| 7 | 1 1 1 | 15 | 1 1 1 1 | 1 1 1 1 1 |
| | MSB LSB | | MSB LSB | MSB LSB |

FIG. 19

FIG. 16

| Type of Operation | Output of Enrble Decoder 100 | | | | | | | |
|---|---|---|---|---|---|---|---|---|
| | XM | XE | XV | XT | XS | XN | XW | XP |
| E | H | H | L | L | L | L | L | L |
| V | H | L | H | L | L | L | L | L |
| T | H | L | L | H | L | L | L | L |
| S | H | L | L | L | H | L | H | L |
| N | H | L | L | L | L | H | H | L |
| P | L | L | L | L | L | L | L | H |

| Operating Frequency | Band Discriminating Signal | Low Pass Filter and Cut-OFF Fre. | |
|---|---|---|---|
| 1.25 kHz | 0 0 0 | 4 1 0 | 0.55 kHz |
| 2.5 kHz | 0 0 1 | 4 2 0 | 1.1 kHz |
| 5 kHz | 0 1 0 | 4 3 0 | 2.2 kHz |
| 10 kHz | 0 1 1 | 4 4 0 | 4.4 kHz |
| 20 kHz | 1 0 0 | 4 5 0 | 8.8 kHz |

FIG. 17

| Row | C3 | Col | C1 | 5 Bit MA Signal | Type Element | Output of Enable Decoder 100 | | | | | | | |
|---|---|---|---|---|---|---|---|---|---|---|---|---|---|
| | | | | | | XM | XE | XV | XT | XS | XN | XW | XP |
| 0 | 0000 | 0 | 000 | 01010 | S/3 | H | L | L | L | H | L | H | L |
| 1 | 0001 | 0 | 000 | 00000 | E | H | H | L | L | L | L | L | L |
| 2 | 0010 | 0 | 000 | 01100 | S/4 | H | L | L | L | H | L | H | L |
| 3 | 0011 | 0 | 000 | 00001 | V | H | L | H | L | L | L | L | L |
| 4 | 0100 | 0 | 000 | 01101 | S/5 | H | L | L | L | H | L | H | L |
| 5 | 0101 | 0 | 000 | 00010 | T | H | L | L | H | L | L | L | L |
| 6 | 0110 | 0 | 000 | 01000 | S/1 | H | L | L | L | H | L | H | L |
| 7 | 0111 | 0 | 000 | 01011 | S/□ | H | L | L | L | H | L | H | L |
| 8 | 1000 | 0 | 000 | 01010 | S/3 | H | L | L | L | H | L | H | L |
| 9 | 1001 | 0 | 000 | 11111 | P | L | L | L | L | L | L | L | H |
| 10 | 1010 | 0 | 000 | 01100 | S/4 | H | L | L | L | H | L | H | L |
| 11 | 1011 | 0 | 000 | 11111 | P | L | L | L | L | L | L | L | H |
| 12 | 1100 | 0 | 000 | 01101 | S/5 | H | L | L | L | H | L | H | L |
| 13 | 1101 | 0 | 000 | 11111 | P | L | L | L | L | L | L | L | H |
| 14 | 1110 | 0 | 000 | 01001 | S/2 | H | L | L | L | H | L | H | L |
| 15 | 1111 | 0 | 000 | 11111 | P | L | L | L | L | L | L | L | H |
| | MSB LSB | | MSB LSB | MSB LSB | | | | | | | | | |

Key Time
Column Times
0
1
2
3
4
5
6
7
(D1)
(D2)
RAM 142 Write Pulse
RAM 141 Write Pulse
F0
RAM 141 Out
RAM 142 Out
RP
A
B
C
H
L Output Analog Signal From Contents of RAM 320
0
H
L
t1 t2
t3 t4 t5

Max. Value
Zero
a
b

WAVE SYNTHESIZING APPARATUS

This is a continuation of application Ser. No. 180,457, filed Aug. 22, 1980 now abandoned.

BACKGROUND OF THE INVENTION

1. Field of the Invention

This invention relates to a waveform synthesizing apparatus adapted to produce a desired synthesized waveform by adding partial waveforms together.

2. Description of the Prior Art

FIG. 1 is a block diagram of one example of a prior art electronic musical instrument of a type for generating a synthesized waveform by adding partial waveforms together. This system is disclosed in more detail in U.S. Pat. No. 3,854,365. In the system of FIG. 1, peak values of each-order harmonic wave, or of each partial waveform, are read out from a read-only memory (ROM) as a digital signal by corresponding sampling frequencies, and thus read-out data is subjected to frequency operation. An operation output obtained by the above frequency operation is multiplied by digital data of tone spectrum, time spectrum, envelope, loudness and the like in order, and the resultant output is converted into an analog signal which is obtained through a filter at an output end.

However, when peak values of each partial waveform are operated by the same operation frequencies as mentioned above, the peak values of respective partial waveforms are required to be individually memorized in a memory, so that the capacity of the memory becomes gigantic and also the number of operations is increased. Particularly, in the case of a polyphonic system, it is necessary to provide a memory at every sound and also to provide operation circuits for plural sounds in parallel. As a result, the construction becomes quite complicated.

Another prior art system is disclosed in U.S. Pat. No.

SUMMARY OF THE INVENTION

Accordingly, it is a main object of this invention to provide a waveform synthesizing apparatus in which the output of each partial waveform such as each-order harmonic wave, subharmonic wave, nonharmonic component, noise or the like is carried out by output or operation frequencies corresponding to or higher than the sampling frequencies required by each partial waveform so as to make it possible to reduce the capacity of a memory, to decrease the number of operations, to simplify the construction, and to reliably remove clock components of the operation.

According to the main feature of this invention, a waveform synthesizing apparatus for producing a desired synthesized waveform by adding-up partial waveforms is provided, in which peak values of each partial waveform are read out at output frequencies corresponding to or higher than the sampling frequencies required by each partial waveform to provide accumulated digital outputs, which are converted to analog signals, supplied to low-pass filters, each having a cut-off frequency corresponding to each of the output frequencies, to remove therefrom clock components, and outputs of the low-pass filters are added together in an analog adder to obtain a synthesized waveform.

The other objects, features and advantages of this invention will be apparent from the following description taken in conjunction with the accompanying drawings.

In summary, my inventive apparatus includes an electronic storage means wherein are stored the times over a complete cycle, when signals corresponding to the fundamental, harmonics, subharmonics and noise are to be output to form a composite output wave. A digital calculating means with a feedback loop forms addresses or data associated with peak values of sine wave, noise, loudness, envelope shape and tone amplitudes. All such amplitude information is in logarithmic form and when the time occurs to output a partial signal corresponding to a selected harmonic, for example, appropriate peak values of sine wave, envelope shape, loudness and tone, all in logarithmic form, are added together in an accumulator. The accumulated outputs are passed through an anti-log circuit which produces a digital, composite, non-logarithmic, partial waveform which is passed through a digital-to-analog converter, a bank of low-pass filters and finally an analog adder to produce the resultant composite audio signal.

My invention also includes a method of producing synthesized waveforms including the steps of:

- digitally storing the times, within a selected cycle, wherein a selected fundamental frequency, its harmonics and subharmonics are to be read out;
- digitally storing characteristic information of the wave shapes to be synthesized such as envelope shape, loudness, tone, and peak values of a selected waveshape, such as a sine wave, over one period;
- cycling the stored time data at a selected rate and for each piece of data defining a certain type of waveform such as fundamental or selected harmonic or subharmonic forming a digital signal of a corresponding amplitude based on the stored characteristic information and digital values previously calculated within the same cycle;
- converting the digitized signals to a composite analog audio signal.

BRIEF DESCRIPTION OF THE DRAWINGS

FIG. 2 through 5 are views used for explaining the principles of operation of the present invention;

FIG. 6 to 8 are logic diagrams showing one example of a waveform synthesizing apparatus according to this invention which is constructed as a polyphonic-type electronic musical instrument;

FIGS. 12 through 15 are lists which show the contacts of certain memory units used in this apparatus; and FIG. 16 to FIG. 26, inclusive, are views used for explaining the operations of this apparatus.

DESCRIPTION OF THE PREFERRED EMBODIMENT

Not by way of limitation but by way of disclosing the best mode of practicing my invention and by way of enabling one of skill in the art to practice my invention, there is shown in FIGS. 2 to 26 one example of a waveform synthesizing apparatus according to my invention.

My invention is based on storing in the logic circuits, over a predetermined cycle time, the times when a desired fundamental, its harmonics and associated noise should be output to comply with the requirements of the sampling thereon. At each operation time, the amplitude of the partial waveshape to be output is calculated.

The output sigital, partial waveforms are converted to analog signals, passed through low-pass filters to eliminate non-audio related high frequency components and then added together to form a synthesized output signal.

Figure 1:
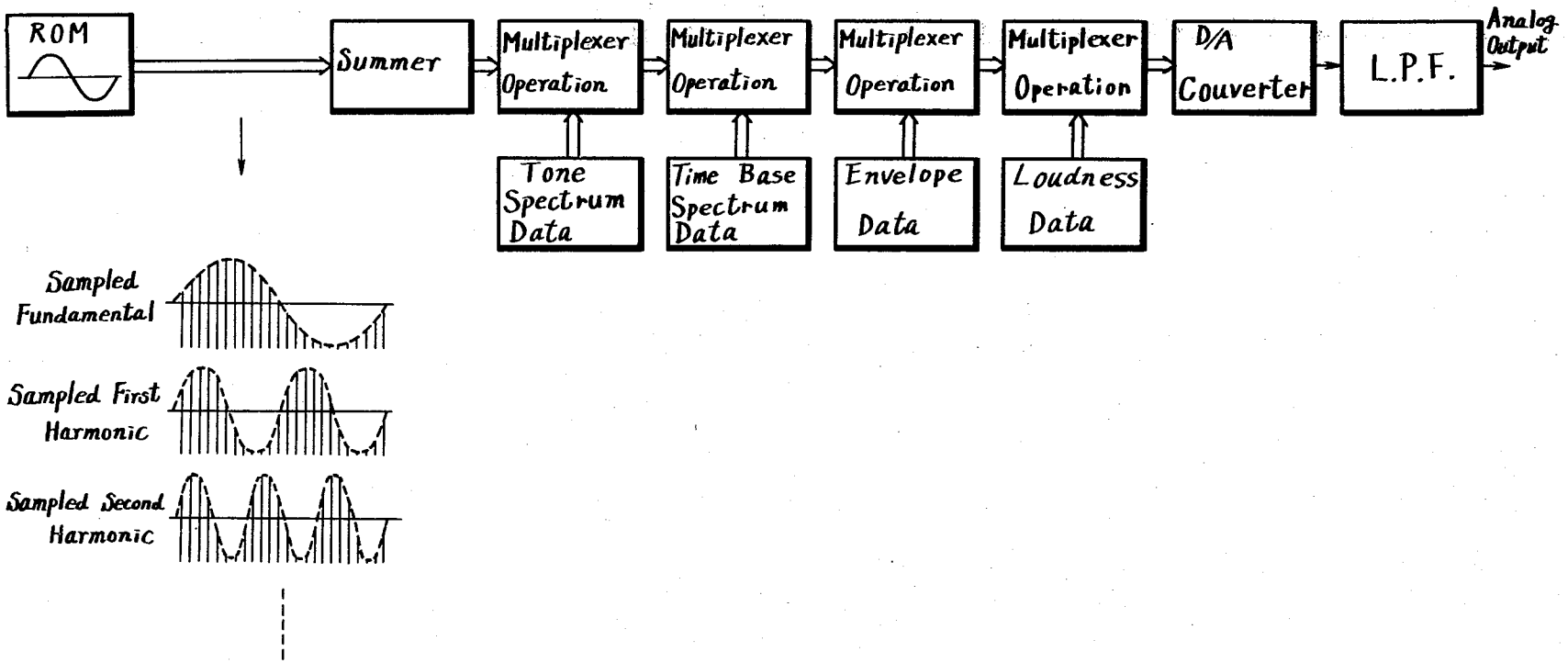
FIG. 1 (PRIOR ART)
FIG. 1 is a systematic view showing one example of prior art electronic musical instruments.
Figure 2:
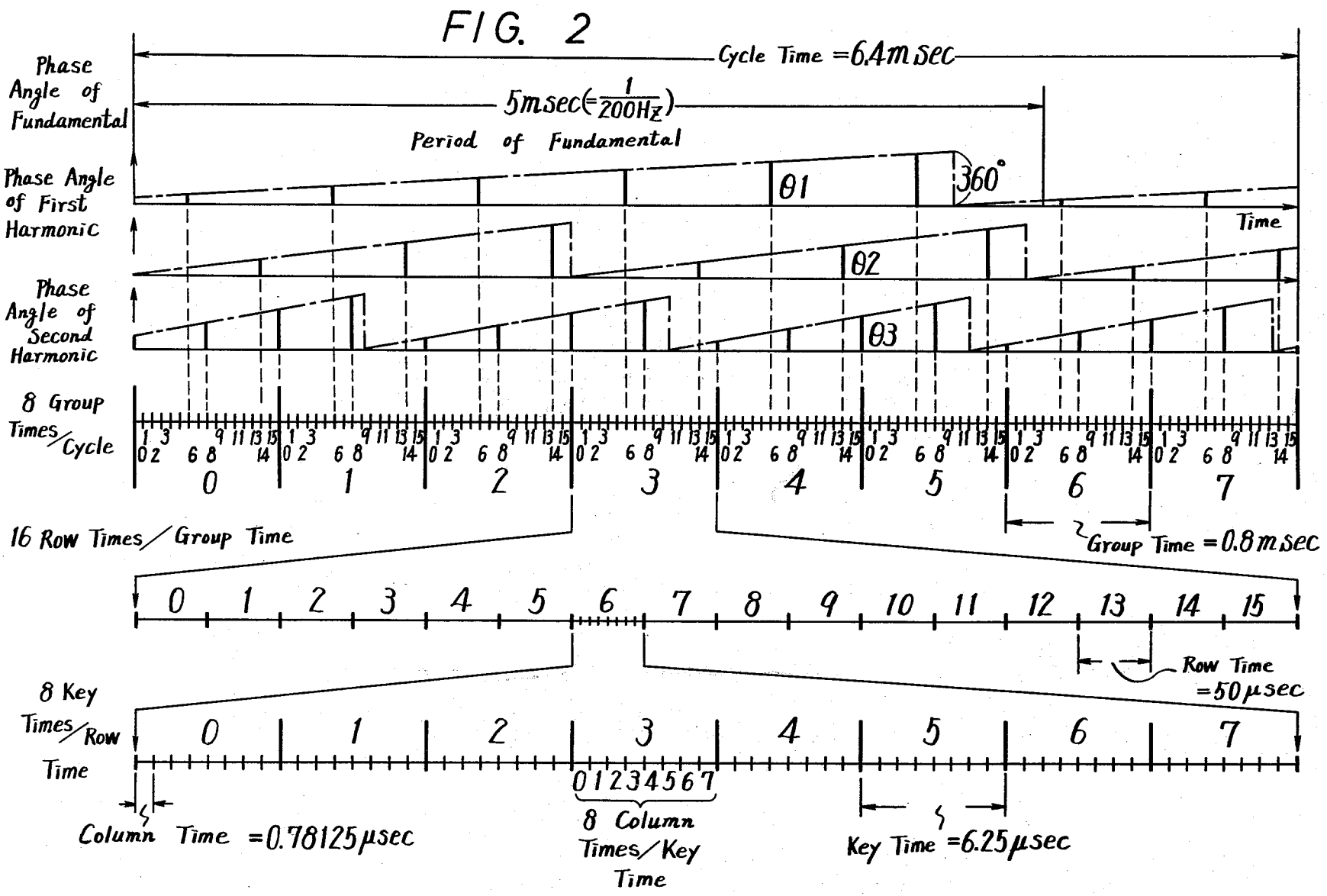

In FIG. 2 is shown a selected cycle of 6.4 milli sec which is to be used to create a 200 Hz fundamental waveform and 20 higher frequency harmonics. In the top three rows of FIG. 2 are shown the phase angles, as a function of time, for the fundamental, first and second harmonics. The bottom three rows show the sub-division of a cycle into incremental operation times. At the highest level, each cycle is divided into eight groups. Each group is divided into 16 row times. Each row time is divided into 8 key times. Each key time is divided into 8 column times. Each column time is the basic system operation time wherein a selected partial waveform is calculated.

The arrangement of FIG. 2 can be used to implement a polyphonic instrument wherein up to 8 keys out of 63 may be depressed at once.

As shown in FIG. 2, a column time is first considered corresponding to the fundamental operation time. For example, eight column times indicated by column 0, column 1, . . . , column 7 are combined to form a key time. Similarly, for example, eight key times indicated by key 0, key 1, . . . , key 7 are combined to form a row time, and sixteen row times indicated by row 0, row 1, . . . , row 15 are combined to form a group time. Similarly, for example, eight group times indicated by group 0, group 1, . . . group 7 are combined to form a cycle time.

As an example each of the above times is taken as follows:

Column time (fundamental operation time the period of the operation or output frequency): 0.78125 μsec.
Key time: 6.25 μsec.
Row time: 50 μsec.
Group time: 0.8 msec.
Cycle time: 6.4 msec.

In FIG. 3 is a matrix time table showing the 8 group times from FIG. 2 along with the 8 key times from FIG. 2. The intersection of a group time and a key time in FIG. 3 requires the specification of a row and column time to determine exactly where in the 6.4 msec. cycle the instrument is.

Two examples associated with row and column times are shown in FIGS. 4 and 5. FIG. 4 is a table, used at each intersection of a group and key time of FIG. 3 to determine the times within a cycle when partial waveforms for a key with a 200 Hz fundamental, its associated harmonics or subharmonics or noise are to be formed. FIG. 5 is a corresponding table for a key with an 800 Hz fundamental.

The fundamental, harmonics, subharmonics and noise signals can thus be regarded as components of the total signal to be generated. This signal is associated with a specific key that has been depressed. The phrases "sine wave components", "harmonic components", "subharmonic components" or "non-harmonic components" used hereafter in this specification thus refer to parts of a selected total wave shape which is to be generated and which is associated with a depressed key.

The phrase "operation time" used hereafter in this specification refers to a time interval during which a certain type of waveform amplitude may be calculated based on stored information corresponding to FIGS. 4, 5.

In the tables of FIGS. 4 and 5, the following symbols are employed.

S: sine wave, wherein
- S/1—first harmonic wave (fundamental wave)
- S/2—second harmonic wave (sometimes called the first harmonic)
- S/$\frac{1}{2}$—second subharmonic wave
- S/$\frac{1}{3}$—third subharmonic wave
- S□—nonharmonic component lower than 0.55 kHz
- S/Δ—nonharmonic component lower than 1.1 kHz N: noise lower than 1.1 kHz
E: envelope,
V: stress (keying strength, loudness)
T: time lapse from an instant of keying, and
P: time spectrum (variation in intensity of spectrum of each partial waveform according to the lapse of time)

The entries in the tables of FIGS. 4, 5 are thus identifiers of types of waveforms whose amplitude values are to be calculated and generated during a time interval corresponding to the table entry.

That is, the operations of four elements other than partial waveforms, that is, envelope E, stress V, time lapse T and time spectrum P, are assigned to the same time of 16-row and 8-column matrix time table with respect to any keys. The operation of each partial waveform is assigned so as to have an operation or output frequency higher than sampling frequency required by this partial waveform with respect to each key. For example, when the key has the fundamental frequency of 200 Hz, as in FIG. 4, the operation of the first harmonic wave is assigned to only a time of column 0 and row 6, the operation of second harmonic wave is assigned to only a time of column 0 and row 14, and the operation of third harmonic wave is assigned to a time of column 0 and row 0 and a time of column 0 and row 8. Thus, higher frequency components are output at a higher rate than are lower frequency components.

References to "operation times" subsequently refer to those times specified by matrices such as in FIGS. 4 or 5 when an amplitude component for a specified sine wave or non-harmonic wave may be generated.

Since the row time is taken as 50 μsec., the operation frequency can be selected to maximum 20 kHz and harmonic waves up to about 8 kHz can be reproduced. In FIGS. 3, 4 and 5, MSB represents most significant bit and LSB least significant bit, respectively.

Figure 6:
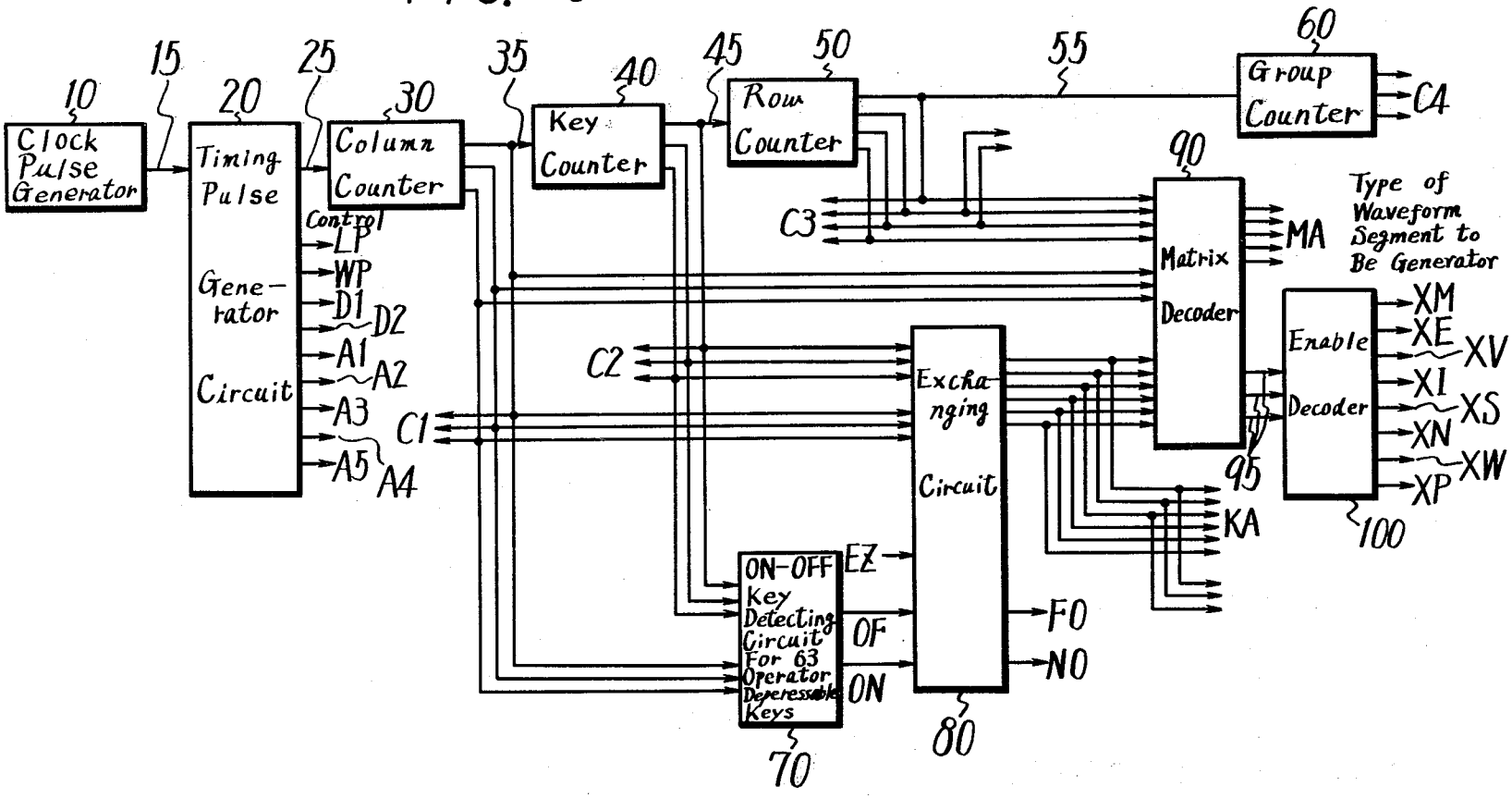
Figure 8:
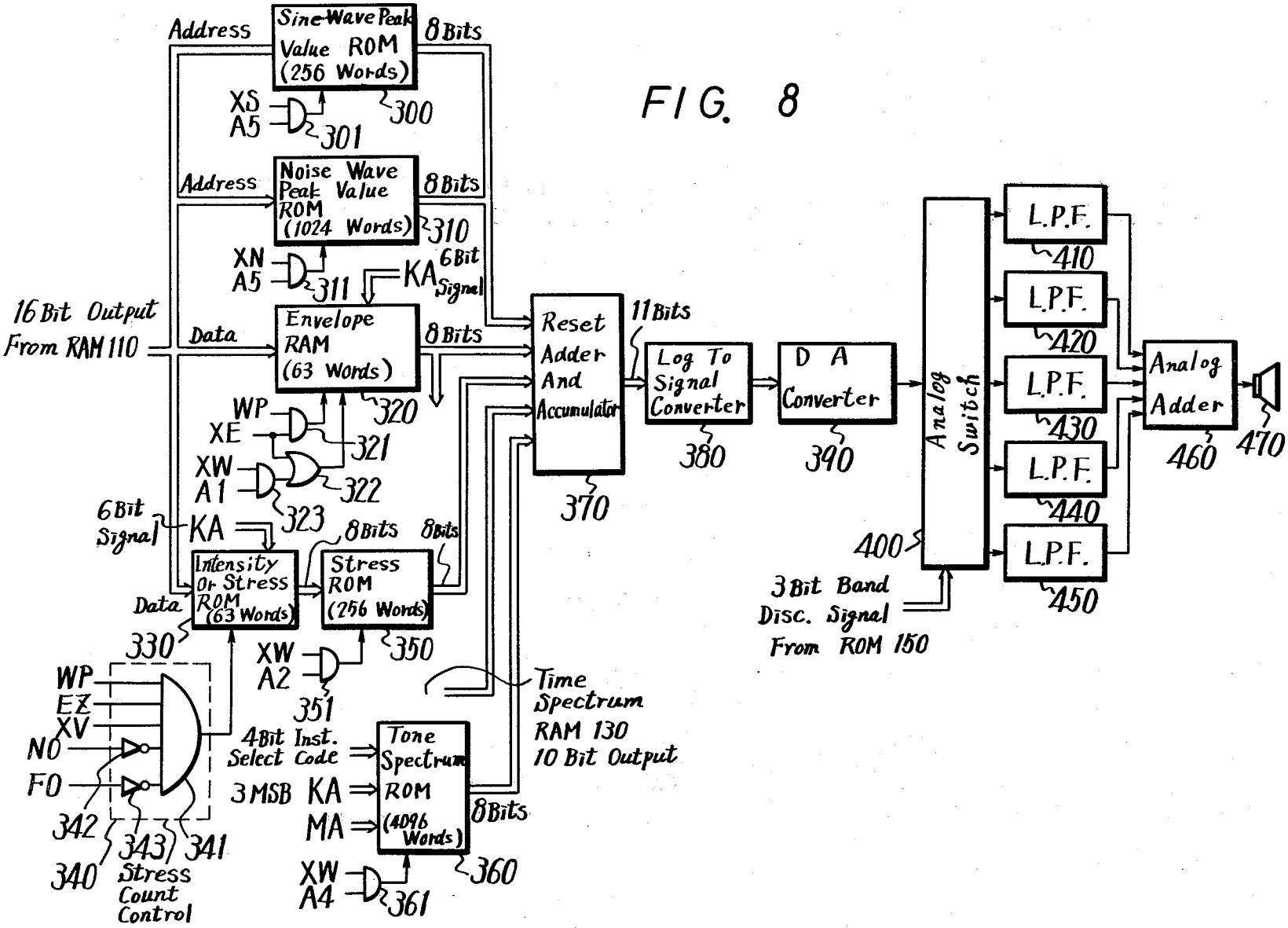

FIGS. 6, 7 and 8 show one example of a waveform synthesizing apparatus incorporating the principles of this invention. The exemplary instrument is constructed as a polyphonic type electronic musical instrument with a total of 63 keys and wherein up to 8 keys may be simultaneously depressed. The function of each element will be below outlined item by item.

In FIG. 6, a clock pulse generator 10 generates a clock pulse on a line 15 whose period is shorter than column time of FIG. 2 which is the fundamental operation time.

The fundamental operation time, the column time, defines a selected time interval during which an amplitude value for the corresponding type of waveform may be calculated.

Clock pulses on the line 15 from the clock pulse generator 10 are fed to a timing pulse generating circuit 20. The circuit 20 frequency-divides the clock pulses on the line 15 to produce a clock pulse on a line 25 whose period is the same as the column time (fundamental operation time), a latch pulse LP, write pulse WP, additional write pulses $D_1$, $D_2$ and adding pulses $A_1$, $A_2$, . . . , $A_5$ within this column time.

The clock pulses on the line 25 from the timing pulse generating circuit 20 are fed to a column counter 30. The column counter 30 generates a 3-bit binary output $C_1$ for discriminating times of column 0, column 1, . . . , column 7 in one key time. The most significant bit of the output $C_1$ of column counter 30, that is, the pulse with a period equal to key time is supplied by a line 35 to a key counter 40. The key counter 40 generates a 3-bit binary output $C_2$ for discriminating times of key 0, key 1, . . . , key 7 in one row time. (Up to 8 keys can be depressed simultaneously.) Similarly, the most significant bit of the output $C_2$ of key counter 40, that is, the pulse with its period equal to row time is supplied by a line 45 to a row counter 50. The row counter 50 generates a 4-bit binary output $C_3$ for discriminating times of row 0, row 1, . . . , row 15 in one group time. Further, the most significant bit of the output $C_3$ of row counter 50, that is, the pulse with its period equal to group time is fed by a line 55 to a group counter 60. The group counter 60 generates a 3-bit binary output $C_4$ for discriminating times of group 0, group 1, . . . , group 7 in one cycle time.

An ON-OFF detecting circuit 70 is provided, which has, for example, sixty-three (63) switches corresponding to the manually operable 63 keys. The output C2 of key counter 40 and the output $C_1$ of column counter 30 are respectively supplied to the ON-OFF detecting circuit 70 to scan the 63 keys in a time-sharing manner and to generate an on-signal "ON" and off-signal "OFF" which indicate whether or not a scanned key is being touched at times corresponding to the times discriminated by outputs $C_2$ and $C_1$ in a time sharing manner.

Figure 20:
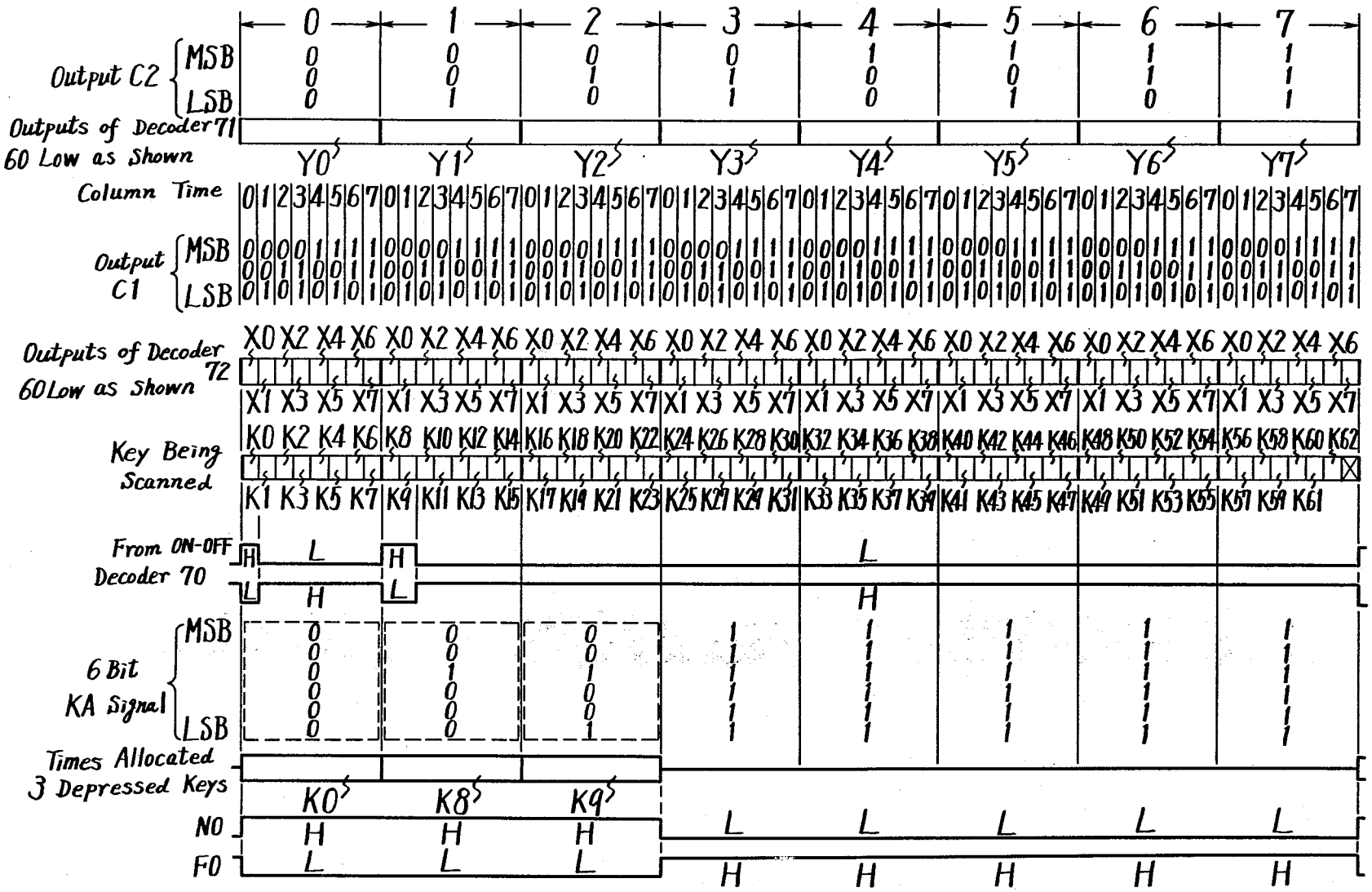

The on-signal "ON" and off-signal "OF" from ON-OFF detecting circuit 70 are supplied to an exchanging circuit 80 together with the output $C_2$ of key counter 40 and the output $C_1$ of column counter 30 to generate an exchanged on-signal "NO" and off-signal "FO" The signals "NO" and "FO" indicate how many keys have been touched and assign each such key a slot in the key times of key 0, key 1, . . . , key 7, one by one in order. The exchange circuit generates a 6-bit key address signal KA which indicates which one of the 63 keys is the assigned key in a specific assigned key time. Since up to 8 keys may be depressed at once, the depressed keys can fill the available 8 key times. FIG. 20 discussed more fully later, shows the relationships between key times, depressed keys and signals generated by the exchange circuit 80.

The key address signal KA from exchanging circuit 80 is supplied to a matrix decoder 90 together with the output $C_3$ of row counter 50 and the output $C_1$ of column counter 30 to generate a 3-bit output on a group of lines 95 showing which one of six operations of sine wave, noise, envelope, stress or loudness, time lapse, and time spectrum is carried out in accordance with the touched key at a time of each row and each column of 16-row and 8-column matrix time table in the key time assigned to the touched key. The matrix decoder 90 also generates a 5-bit parallel output MA that indicates which one among a maximum of 32 operations such as forming an element of a first harmonic wave, second harmonic wave, sub-harmonics . . . , noise, envelope, stress, time lapse and time spectrum is to be performed.

Thus, matrix decoder 90 stores the information corresponding to FIG. 4 or FIG. 5 for each of the 63 available keys. Much of the rest of the circuitry to be discussed is for the purpose of calculating the amplitude of the selected type of partial wave to be output in a selected column time.

The 3-bit output 95 from matrix decoder 90 for showing one of six operations is supplied to an enable decoder 100 where it is decoded to generate an eight bit output labelled XM, XE, XV, XT, XS, XN, XW and XP for controlling the operation of each type of element calculation. FIG. 16 shows levels of about eight outputs, in which the XM is high in level "H" at respective operation times of envelope E, stress or loudness V, time lapse T, sine wave S and noise N and is at a low level "L" at the operation time of the time spectrum P. Similarly, the output XE is "H" at the operation time of envelope E only. The output XV is "H" at the operation time of stress V only. The output XT is "H" at the operation time of time lapse T only. The output XS is "H" at the operation time of sine wave S only. The output XN is "H" at the operation time of noise N only. The output XW is "H" at the operation times of sine wave S and noise N. The output XP is "H" at the operation time of time spectrum P only. Accordingly, at times of row 0, row 1, . . . , row 15 and column 0 is a key time assigned to the operation of key whose fundamental frequency is, for example, 200 Hz, the levels of outputs XM, XE, XV, XT, XS, XN, XW and XP become as shown in FIG. 17.

In FIG. 7, a main random access memory 110 functions to cyclically perform the calculation operations of respective types of elements except time spectrum. The memory 110 has 63 blocks for the operation of 63 keys. Each block has 32 words. Respective words are assigned to the operation of the maximum 32 elements except time spectrum. Each word is composed of sixteen bits. For example, the block corresponding to the key with a fundamental frequency of 200 Hz is assigned as shown in FIG. 12. As a result, the key address signal KA from exchanging circuit 80 is applied to the memory 110 as the address signal of blocks and the output MA of matrix decoder 90 is applied thereto as the address signal of words.

The 3-bit output $C_4$ of group counter 60 is combined with two bits of the output $C_3$ of row counter 50 excepting its most significant bit and least significant bit to form a 5-bit signal MB. The signal MB is fed to a switch circuit 120 at its B-terminal, while the output MA of matrix decoder 90 is fed to its A-terminal. The switch circuit 120 is also applied with the output XM of enable decoder 100 to be changed over so that the signal MB or MA can be derived therefrom. The signal MB which is formed of the output $C_4$ of group counter 60 as its upper three bits and two bits of the output $C_3$ of row counter 50 excepting its most significant bit and least significant bit as its lower two bits as shown in FIG. 18, and hence served to distinguish total 32 times of row 9, row 11, row 13 and row 15 at each of group 0, group 1, . . . , group 7 in which the operation of time spectrum is to be performed.

Figure 14:
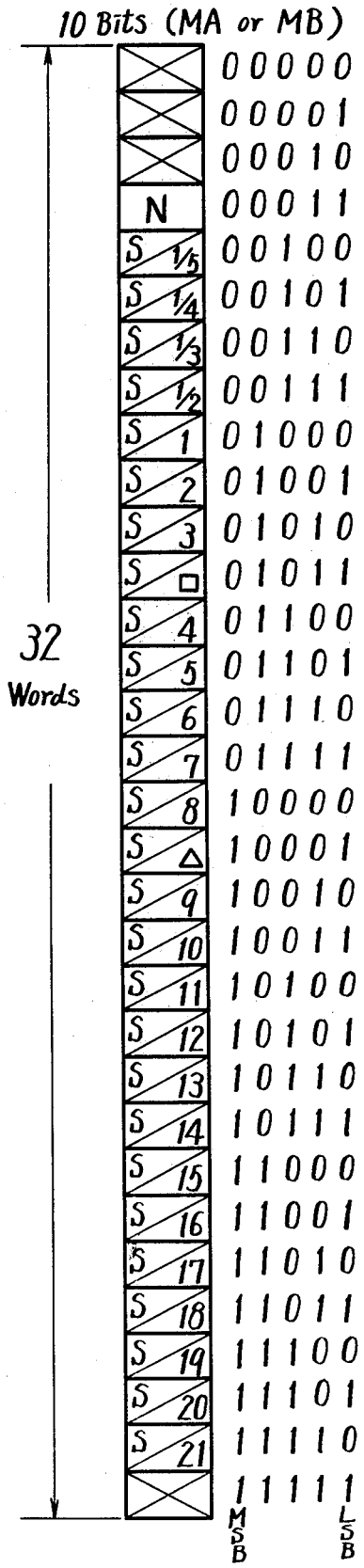

A time spectrum random access memory 130 is provided for performing the operations of time spectrum. This memory 130 has 63 blocks for the operations of 63 keys. Each block has 32 words and respective words are assigned to the operations of time spectrum for respective sine wave components and noise. Each word is formed of ten bits. For example, the block corresponding to the key with its fundamental frequency of 200 Hz is assigned as shown in FIG. 14. As a result, the key address signal KA from exchanging circuit 80 is fed to the memory 130 as the address signal of blocks and the output of switch circuit 120 is fed thereto as the address signal of words.

A reset pulse generating circuit 140 is fed with, for example, the off-signal FO from exchanging circuit 80 to generate a reset pulse for clearing the contents of all words of a block corresponding to a touched key of memory 110. A practical example in FIG. 10 of this reset pulse generating circuit 140 will be described later.

Next, unit data for operating elements other than envelope and time spectrum, and band discriminating signals related to respective sine wave components and noise are generated by a main data read-only memory 150, which is provided with 63 blocks in accordance with 63 keys. Each block has 32 words, and respective words have stored therein unit data in logarithmic form for the operations of respective sine wave components, noise, stress and time lapse, and band discriminating signals relating to respective sine wave components and noise. With respect to each sine wave component and noise, the unit data corresponds to a phase angle of operation period and is expressed as follows:

$$360° \times (\text{operation period}/\text{period of waveform itself})$$

In this case, since the operation period is selected smaller than $\frac{1}{2}$ of the period of waveform itself, it does not exceed 180° at most. As to the first harmonic wave in the key having its fundamental frequency of, for example, 200 Hz, the period of the above wave itself is 5 msec., and as obvious from FIGS. 2 and 4, one operation is carried out during a group time of 0.8 msec., that is, the operation period of 0.8 msec., so that $360° \times (0.8 \text{ msec.}/5 \text{ msec.}) = 57.6°$ is substantially obtained. The unit data is formed as a 13-bit digital signal. While, the band discriminating signal is adapted to discriminate one of, for example, five separated bands. Each band corresponds to the frequency of waveform itself or the output or operation frequency of each sine wave component or noise, and formed as a 3-bit digital signal. The above relation is shown in FIG. 19, in which the first harmonic wave of the key having its fundamental frequency of 200 Hz has its own frequency of 200 Hz and an output or operation frequency of 1.25 kHz, so that the band discriminating signal is "000". The block corresponding to the key having the fundamental frequency of 200 Hz is stored therein with unit data and band discriminating signals as shown in FIG. 13. The key address signal KA from exchanging circuit 80 is supplied to the memory 150 as the address signal of blocks and the output MA of matrix decoder 90 is supplied thereto as the address signal of words.

An envelope addition circuit 160 is provided, which is supplied with an 8-bit signal (from RAM 320), indicating each occasional amplitude of envelope in a time-sharing manner, from an envelope random access memory 320 to be described later to generate a signal EZ indicating in a time-sharing manner whether the envelope of each key is zero or not, or whether the sound of each key is output or not, and a signal EU indicating in a time-sharing manner whether the envelope is in a rising mode or falling mode. An example of envelope addition circuit 160 will be described later.

An envelope data read-only memory 170 functions to generate gradient data of the envelope. The memory 170 includes 1048 words and different gradient data are stored in respective words. The output date of ROM 170, in a logarithmic form, is formed as an 8-bit digital signal. To this end, a 4-bit selecting signal generated by an instrument select switch, the key address signal KA of upper three bits from exchanging circuit 80, that is, a signal indicating a group to which the touched key belongs when 63 keys are classified to eight groups, the signal from the memory 320 including upper three bits only, and the signal EU from the envelope addition circuit 160 are respectively applied to this memory 170 as address signals to produce the gradient data.

A time spectrum decoder 180 is a read-only memory served to designate unit data for the operation of time spectrum relative to respective sine wave components and noise. The decoder 180 is addressed by the 4-bit instrument selecting signal generated by the instrument select section, the key address signal KA including the upper three bits only, and an 8-bit signal indicating time lapse from a time count random access memory 200, which will be described later, and generates a 7-bit output signal 185 for designating the data.

Figure 15:
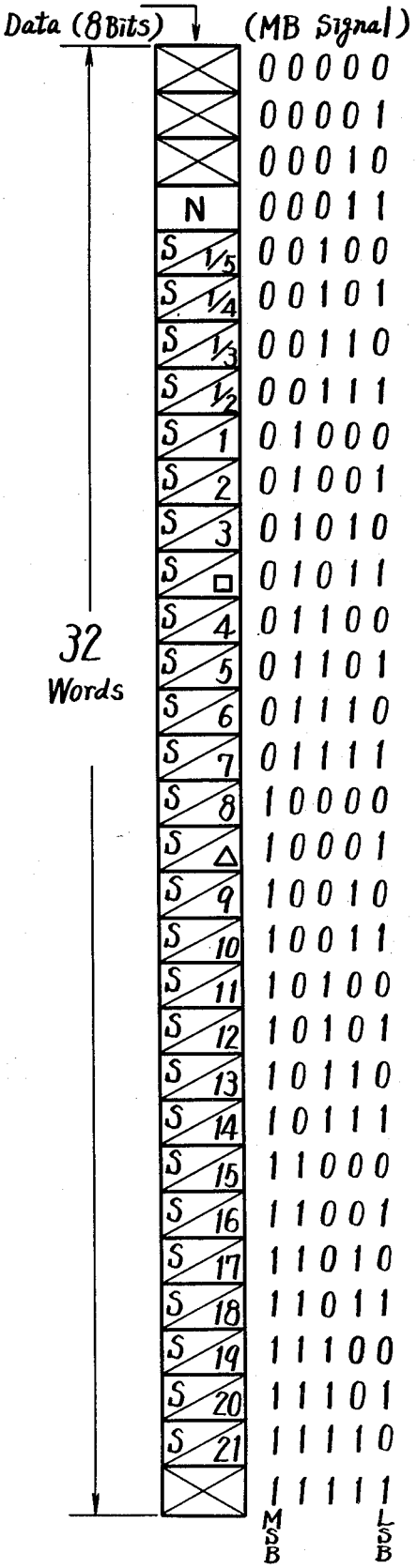

The above 7-bit output signal 185 is applied as an address to a time spectrum data read-only memory 190 to derive therefrom the unit data for the operation of time spectrum to respective sine wave components and noise. The memory 190 has 128 blocks for 128 kinds of data and each block consists of 32 words. As shown in FIG. 15, the respective words are stored therein with unit data corresponding to respective sine wave components and noise. The data in a logarithmic mode is formed as an 8-bit digital signal. The data designating signal 185 from decoder 180 is applied to the memory 190 as the address signal of blocks and the signal MB is applied thereto as the address signal of words.

The time count random access memory 200 is used to temporarily store the operation data of time lapse among the operation data outputs from the memory 110. To this end, the memory 200 has 63 words for storing operation data of 63 keys and each word is composed of eight bits. The key address signal KA from exchanging circuit 80 is supplied to this memory 200 as the address signal of words.

A latch circuit 210, digital adding circuit 220, attenuators 230 and 240, and time count decoder 250 will be later described with reference to the operation.

Figure 22:
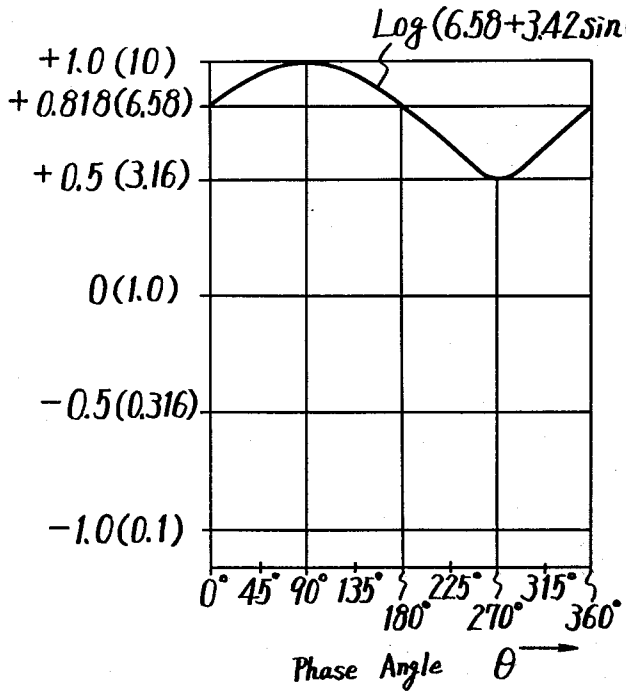
Figure 24:
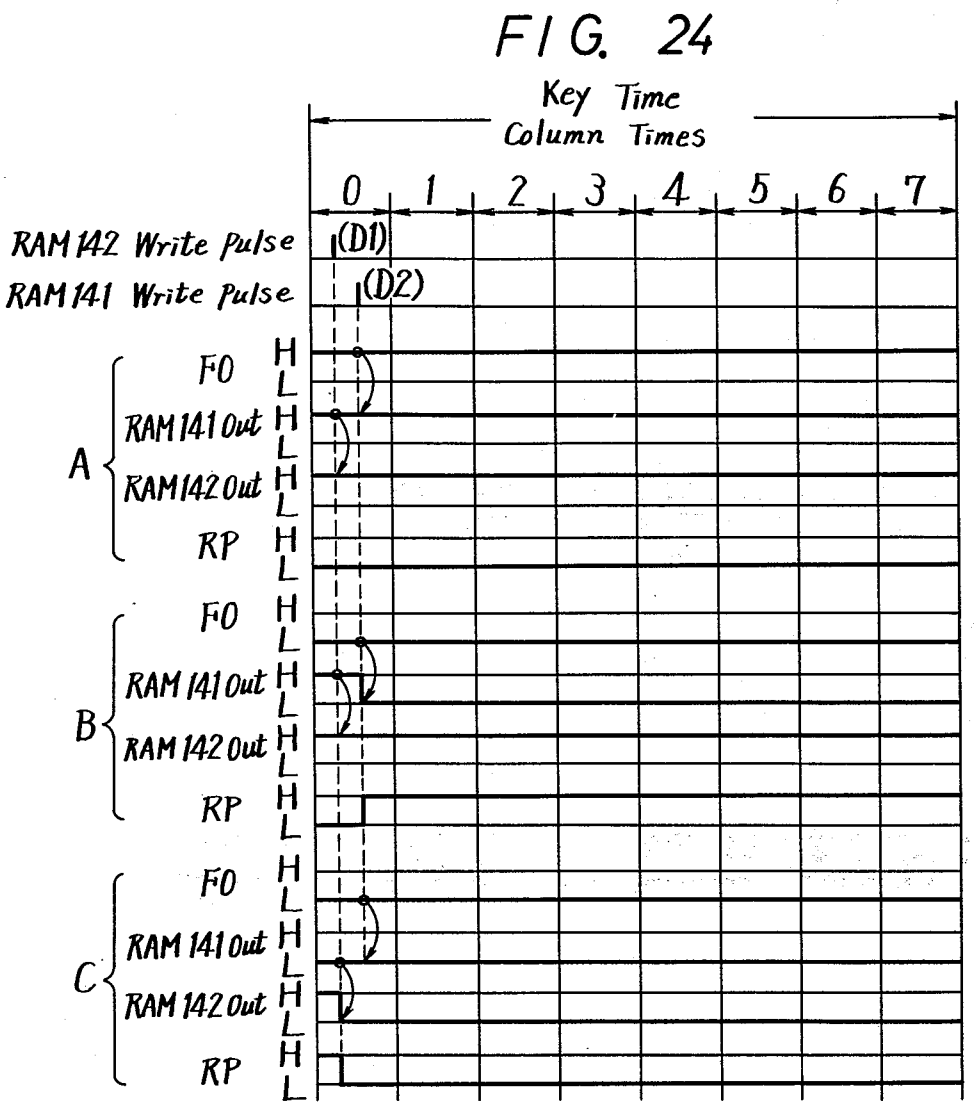

Next, referring to FIG. 8, a sine wave read-only memory 300 includes 256 words to generate data of amplitude values of a sampled sine wave. These 256 words are adapted to store therein data of amplitude values at 256 sampling points within one period of a sine wave. In this case, as shown in FIG. 22, a sine wave superposed on a certain bias is converted to a logarithmic form which is sampled and stored as an 8-bit digital signal.

Similarly, a noise read-only memory 310 has 1024 words to generate sampled data of amplitude values of noise. These words are adapted to store therein amplitude values at 1024 sampling points within one period of noise. In this case, similarly a noise signal is superposed on a certain bias and is converted to logarithmic form which is sampled and stored as an 8-bit digital signal.

An envelope random access memory 320 is a buffer memory to temporarily store the operation data of envelope from among the operation data outputs from memory 110. The memory 320 has 63 words for storing in logarithmic form the operation data of 63 keys and each word is composed of eight bits. The key address signal KA is supplied to the memory 320 as the address signal of words.

A stress or loudness random access memory 330 is also a buffer memory temporarily store in logarithmic form the operation data of stress from among the operation data outputs from memory 110. The memory 330 has 63 words for storing the operation data of 63 keys and each word is formed of eight bits. The key address signal KA is also applied to the memory 330 as the address signal of words.

A stress or loudness count control circuit 340 acts to supply the write pulse WP from the pulse generator 20 to the memory 330 as a count pulse during the stress operation time at a key time assigned to the key. The stress or loudness operation time is the time between when the selected key is initially pressed and when it is fully turned on.

A stress read-only memory 350 is provided for generating 8-bit output stress data. This memory 350 includes 256 words in which are stored 256 kinds of successively changed stress data. Data are expressed as an 8-bit digital signal which is converted into a logarithmic form. The operation data from memory 330 is supplied to the memory 350 as the address signal of words.

A tone spectrum data read-only memory 360 is designed to generate data of the strength of spectrum for determining the tone. This memory 360 has 4096 locations in which 4096 different words of data are stored. The data are formed as an 8-bit digital signal and converted into logarithmic form. The data are selected by the 4-bit instrument selecting signal generated by the instrument selection switch, the key address signal KA including upper three bits only, that is, the signal for indicating a group to which the touched key belongs when 63 keys are classified to eight groups, and the output MA of matrix decoder 90, respectively.

A digital adding circuit 370, inverse logarithm decoder 380, digital-to-analog converter 390, analog switch 400, low-pass filters 410, 420, 430, 440 and 450, analog adding circuit 460, and speaker 470 which form the output composite audio signal will be later described relating to their operations.

It should be noted that ROM memories 170, 180, 360 each have a 4-bit address input referred to above as coming from an instrument selection switch. ROM's 170, 180, 360 can be formed as banks of storage locations. Depending on the instrument selected, the appropriate bank of 2048 words from ROM 170 or the appropriate bank of words from ROM 180, or the appropriate bank of 4096 words from ROM 360 can be addressed to provide the correct envelope shapes, time spectra and tone spectra for the selected instrument.

Figure 9:
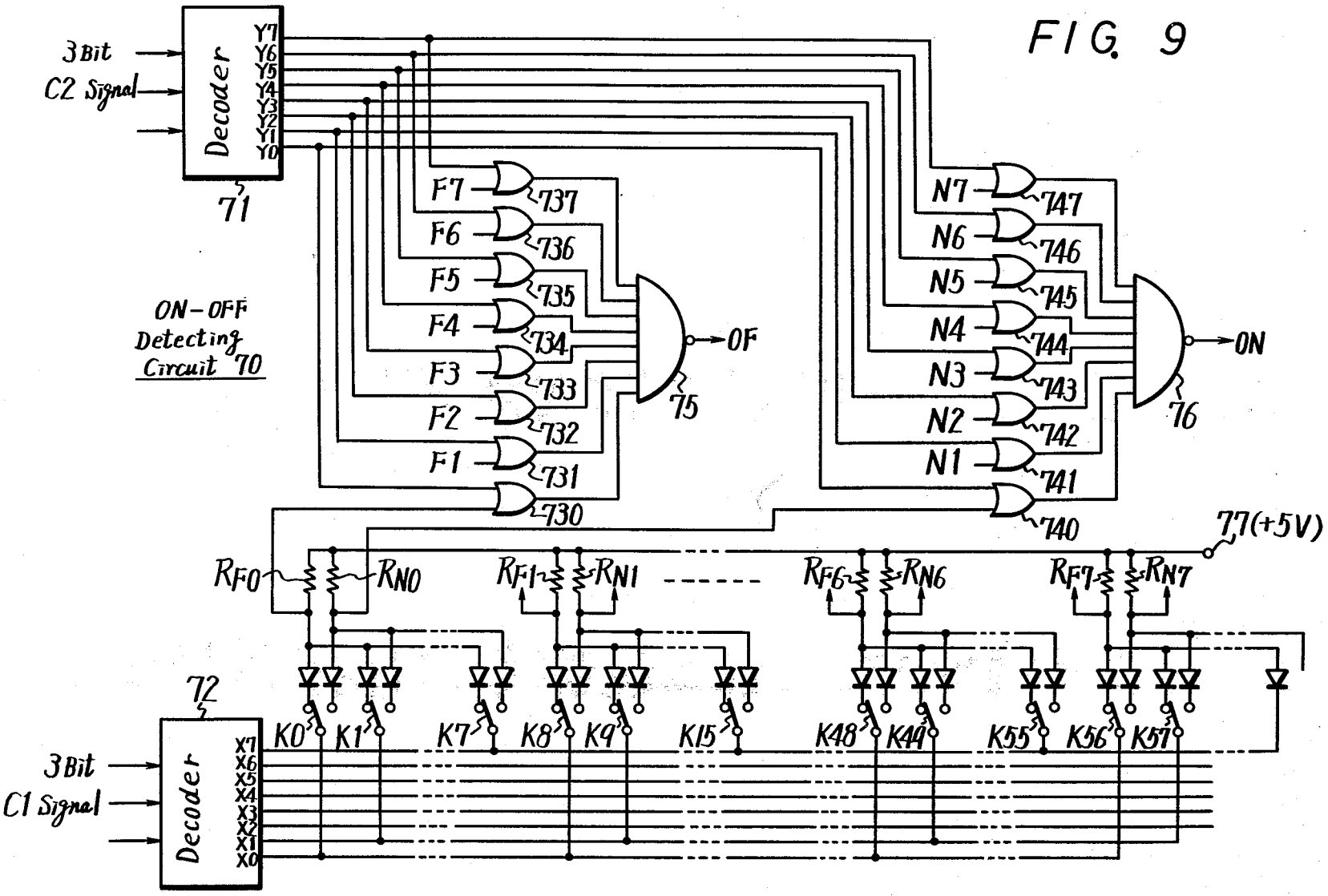
FIG. 9 is a logic diagram showing a practical example of an ON-OFF detecting circuit used in this apparatus.

FIG. 9 shows a practical example of the ON-OFF detecting circuit 70. The circuit 70 is provided with 63 switches $K_0$ through $K_{62}$ corresponding to 63 keys. The circuit 70 also includes two decoders 71 and 72. The decoder 71 is supplied with the 3-bit binary output $C_2$ of key counter 40 to make its eight output lines $Y_0$, $Y_1$, . . ., $Y_7$ respectively "L" in the times of key 0, key 1, . . ., key 7 of FIG. 2. The decoder 72 is supplied with the 3-bit binary output $C_1$ of column counter 30 to make its eight output lines $X_0$, $X_1$, . . ., $X_7$ respectively "L" during the times of column 0, column 1, . . ., column 7 of FIG. 2 within each key time of key 0 to key 7. These conditions are also shown in FIG. 20.

In FIG. 9, the output lines $Y_0$ to $Y_7$ of decoder 71 are each connected to one input of each member of a set of eight OR gates 730 to 737 and to one input of each member of a second set of eight OR gates 740 to 747, respectively. The 63 switches $K_0$ to $K_{62}$ are classified into eight groups, each including eight keys excepting the last group which includes seven keys. The output line $X_0$ of decoder 72 is connected to the movable contact or pole of the first switches $K_0$, $K_8$, . . . , $K_{48}$, $K_{56}$ in respective groups, the output line $X_1$ to second switches $K_1$, $K_9$, . . ., $K_{49}$, $K_{57}$; . . .; and the output line $X_7$ to eighth switches $k_7$, $K_{15}$, . . ., $K_{55}$.

The off-contacts (at the left side of each switch in the figure) of switches $K_0$ through $K_{62}$ in each group are connected through diodes to a common end of a resistor $R_{Fi}$ (i=0, 1, 2, . . . 7). Connection points $F_0$ to $F_7$ are respectively connected to the other inputs of OR gates 730 to 737. The other end of each resistor $R_{Fi}$ is connected to a voltage source terminal 77 at which a positive voltage is obtained.

The on-contacts (at the right side of each switch in the figure) of switches $K_0$ through $K_{62}$ in each group are connected through diodes to a common end of a resistor $R_{Ni}$ (i=0, 1, . . ., 7). Connections points $N_0$ to $N_7$ are connected to the other inputs of OR gates 740 to 747. The other end of each resistor $R_{Ni}$ is connected to the voltage source terminal 77. The outputs of OR gates 730 to 737 are connected to inputs of a NAND gate 75. The outputs of OR gates 740 to 747 are connected to inputs of a NAND gate 76.

When no key is touched and hence all switches $K_0$ through $K_{62}$ are OFF, the potentials at connection points $F_0$ to $F_7$ are always "L" in that one of eight diodes connected to that point is always ON. Each signal of the output lines $Y_0$ to $Y_7$ of decoder 71 appears as it is at the outputs of OR gates 730 to 737 and one among the signals of output lines $Y_0$ to $Y_7$ is always "L" so that an output of NAND gate 75, that is, the off-signal OF becomes always "H". On the contrary, all of the potentials at the connection points $N_0$ to $N_7$ is always "H" and hence any of outputs of OR gates 740 to 747 becomes always "H" so that an output of NAND gate 76, that is, the on-signal ON becomes always "L".

On the other hand, when, for example, three keys corresponding to switches $K_0$, $K_8$, $K_9$ are simultaneously attacked to turn-on the switches $K_0$, $K_8$, $K_9$, the voltage at connection point $F_0$ becomes "H" at the time of column 0 in each key time of key 0, key 1, . . ., key 7. Also, the voltage at connection point $F_1$ becomes "H" at the times of column 0 and column 1 in each key time. Accordingly, at the time of column 0 in key 0 and times of column 0 and column 1 in key 1, the ouputs of OR gates 730 to 737 are all turned to "H" and hence the off-signal OF becomes "L" at the time of column 0 in key 0 and the times of column 0 and column 1 in key 1 as shown in FIG. 20. On the contrary, the voltage at connection point $N_0$ becomes "L" at the time of column 0 in each key time of key 0, key 1, . . ., key 7, and also the voltages at connection point $N_1$ becomes "L" at the times of column 0 and column 1 in each key time. Accordingly, the output of OR gate 740 becomes "L" at the time of column 0 in key 0 and also the output of OR gate 741 becomes "L" at the times of column 0 and column 1 in key 1. Thus, the on-signal ON becomes "H" at the time of column 0 in key 0 and at the times of column 0 and column 1 in key 1 as shown in FIG. 20.

When three keys corresponding to switches $K_0$, $K_8$ and $K_9$ are attacked as mentioned above, as shown in FIG. 20 the off-signal FO from exchanging circuit 80 becomes "L" at the times of key 0, key 1 and key 2 and also the on-signal NO becomes "H" at the times of key 0, key 1 and key 2 thereby to represent the fact that three keys have been touched. Also, the content of key address signal KA sequentially becomes 000000, 001000, 001001, corresponding to switches $K_0$, $K_8$ and $K_9$ to represent the fact that the attached keys are those corresponding to switches $K_0$, $K_8$ and $K_9$. In other words, the key times of key 0, key 1 and key 2 are assigned to the operations of keys corresponding to switches $K_0$, $K_8$ and $K_9$ in order. The assignment of keys to key times takes place with ascending order of keys assigned ascending key times.

In this case, during the key times key 3 to key 7, all bits of key address signal KA are "1" corresponding to the fact that no keys have been depressed and assigned to those key times.

When a key is attacked, the movable contact of the switch is not immediately changed rom the state of being in contact with its off-terminal to the state of being in contact with its on-terminal. Instead, that pole passes through a neutral state where it is not in contact with either of its on- and off-terminals. The time required for changing from the off-state to the on-state varies according to the keying strength. The neutral time becomes shorter as the keying becomes stronger. In a practical situation, however, the time is longer than the group time of 0.8 msec.

Under the condition not in touch with both of the off- and on-contacts of a switch, or the neutral condition, the off-signal OF from ON-OFF detecting circuit 70 becomes "L" at the time corresponding to the switch similarly as the time when it is in touch with the on-contact, and the on-signal ON becomes "L" at the time corresponding to the switch similarly as the time when it is in touch with the off-contact. In other words, the ON-signal ON and off-signal OF become "L" at the times corresponding to the switch. The on-signal NO and off-signal FO from exchanging circuit 80 are also turned to "L" at the assigned key times. Accordingly, when a certain key is attacked by way of example, the on-signal NO and off-signal FO from exchanging circuit 80 are changed in order at the assigned key times in key 0 as shown in FIG. 21.

Figure 10:
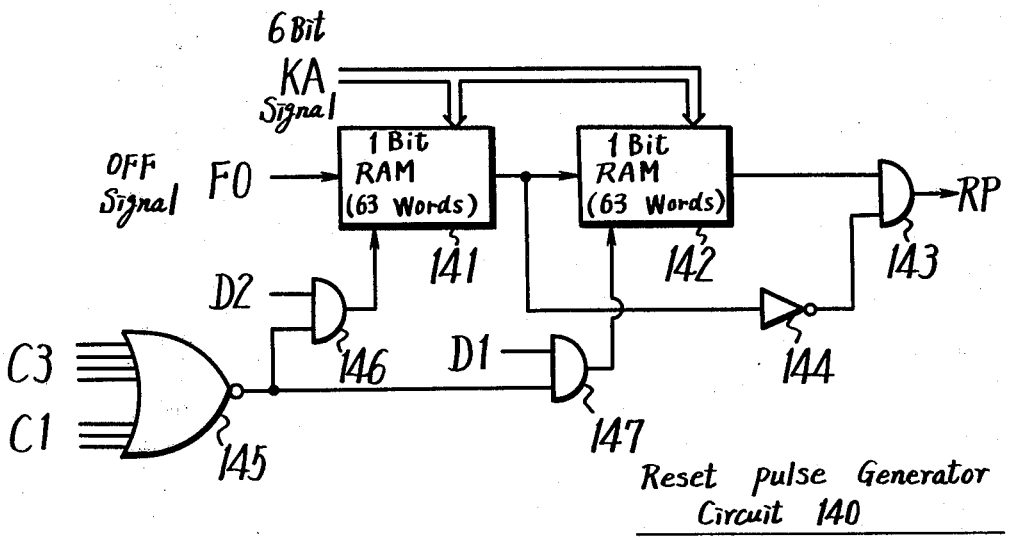
FIG. 10 is a logic diagram showing one example of a reset pulse generating circuit used in this apparatus.

FIG. 10 shows an embodiment of the reset pulse generating circuit 140, which is provided with two random access memories 141 and 142. Each memory 141, 142 has 63 words corresponding to 63 keys. Each word is composed of one bit. The key address signal KA from the exchanging circuit 80 is applied to the memories 141 and 142 as the address signal of each word. The off-signal FO from exchanging circuit 80 is supplied to the data input of the memory 141. The data output, of the memory 141, is then fed to the data input of the memory 142. The data output of memory 142 is supplied to an AND gate 143. The data output of the memory 141 is also inverted by an inverter 144 and supplied to the AND gate 143.

The timing pulse generating circuit 20 generates pulses $D_1$ and $D_2$ in each column time (fundamental operation time) shifted in time from each other. The pulse $D_1$ is generated in advance of the pulse $D_2$. The 4-bit output $C_3$ of row counter 50 and the 3-bit output $C_1$ of column counter 30 are supplied to a NOR gate 145. At a time of column 0 and row 0 in the 16-row and 8-column matrix table, the output of NOR gate 145 becomes "H". Thus, the pulse $D_2$ is supplied through an AND gate 146 to memory 141 and the pulse $D_1$ is supplied through an AND gate 147 to memory 142 respectively as their write pulses at those times. The random access memories 141 and 142 are respectively written therein with input conditions at a time when the write pulses are supplied thereto, and read out at other times.

Figure 21:
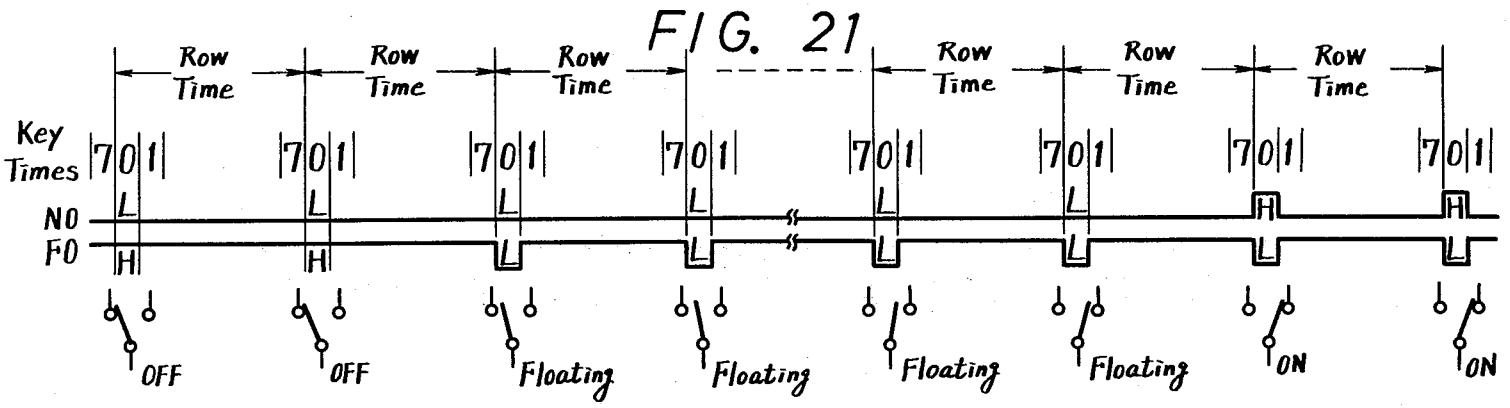

Accordingly, if a certain key is not attacked and the switch corresponding to this is completely off, since the off-signal FO from exchanging circuit 80 is "H" at the key time assigned to the key as apparent from FIG. 21, the outputs of memories 141 and 142 are respectively "H" at the key time and a reset signal RP derived from AND gate 143 is "L" at the key time as shown in FIG. 24A.

Then, when the key is attacked and the pole of the corresponding switch is moved from its off-contact, the off-signal FO becomes "L" at this key time. Therefore, as shown in FIG. 24B, at a time of column 0 of this key time in row 0 at the first group time the output condition of memory 141 is written in memory 142 by the pulse $D_1$ and read out at once. However, since the output of memory 141 is "H", the output of memory 142 remains at the condition of "H". Next, the condition of off-signal FO at that time is written in the memory 141 by the pulse $D_2$ and immediately read out. At this time, the off-signal FO is "L" and hence the output of memory 141 changes from "H" to "L". As a result, the reset signal RP is changed from "L" to "H".

Since the random access memories 141 and 142 are not supplied with write pulses at the times of row 1, row 2, . . . , row 15, as to that key time, the reset signal RP keeps its condition of "H" until the time of column 0 in row 0 at the next group time and this condition is not changed even though chattering of a switch occurs during the process. At the time of column 0 of row 0 in the next group time, if the output condition of memory 141 at that time is written in the memory 142 by the pulse $D_1$, as shown in FIG. 24C, the output of memory 141 at that time is "L", so that the output of memory 142 is changed from "H" to "L" and the reset signal RP is also changed from "H" to "L".

Thus, when a certain key is attacked, the reset pulse generating circuit 140 generates a reset pulse at the key times assigned to that key in all row times from row 0 to row 15 at the first group time.

Figure 11:
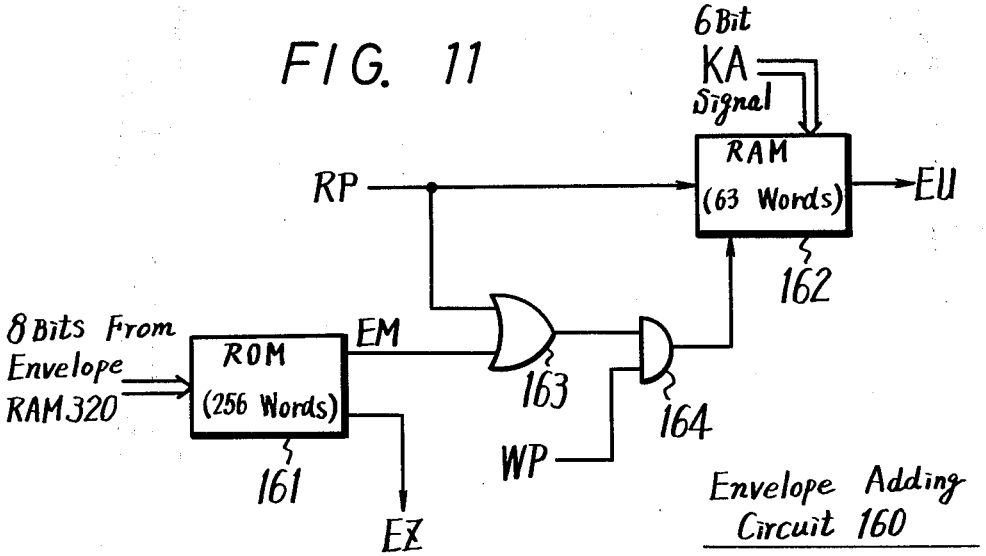
FIG. 11 is a logic diagram showing one example of an envelope addition circuit used in this apparatus.

FIG. 11 shows a practical example of envelope addition circuit 160, which is provided with a read-only memory 161 for data discrimination and a buffer random access memory 162 for temporary storage. The memory 161 has 256 words each of which is formed of two bits and is addressed by an 8-bit signal from memory 320 indicating each occasional amplitude of envelope in a time-sharing manner. The memory 162 has 63 words corresponding to 63 keys, each being formed of one bit, and is addressed by the key address signal KA from exchanging circuit 80.

Figure 25:
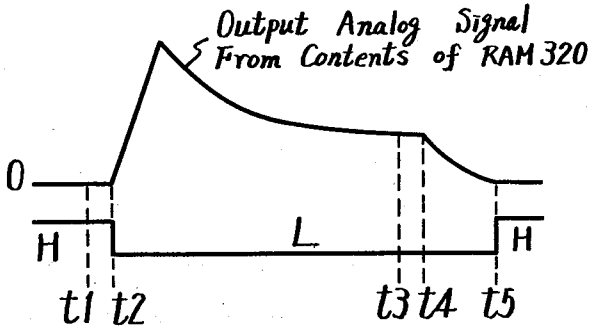

When the data from memory 320 indicating each occasional amplitude of envelope are changed as shown in FIG. 25, the signal EZ read out from one bit of memory 161 is "H" at a time when the envelope is zero in level but "L" at the other time. In other words, the signal EZ is adapted to indicate in a time-sharing manner whether or not the sound of each key is output. Meanwhile, the signal EM read out from the other bit of memory 161 is "H" at a time when the envelope is near the maximum value but "L" at the other time.

The random access memory 162 receives the reset signal RP from reset pulse generating circuit 140 at its data input port. When the reset signal RP becomes "H" at the time of column 0 in row 0 at the key time assigned to the attacked key as mentioned above, the output of an OR gate 163 becomes "H" to deliver the write pulse WP through an AND gate 164 to memory 162 so that the output signal EU of memory 162 is turned to "H", which is the same condition as the reset signal RP at the key time assigned to that key. When the envelope approaches the maximum value to make the signal EM "H", the output of OR gate 163 is similarly turned to "H" to supply the write pulse WP to the memory 162 so that the output signal EU of memory 162 is turned to "L", which is the same condition, as the reset signal RP at the key time assigned to that key. In other words, the output signal EU of memory 162 is adapted to indicate whether the envelope is in a rising mode or falling mode, with respect to time.

The stress or loudness count control circuit 340 shown in FIG. 8 consists of an AND gate 341 and inverters 342 and 343. The write pulse WP from the timing pulse generating circuit 20, the signal EZ from the envelope addition circuit 160, and the output XV of the enable decoder 100 are respectively input directly to the AND gate 341. The on-signal NO and off-signal FO from the exchanging circuit 80 are respectively inverted by inverters 342 and 343 and then fed to the AND gate 341.

In FIG. 25, let it be assumed that a certain key is attacked at a time point $t_1$ so that the movable contact or pole of the switch corresponding to this key is detached from its off-contact and then brought into contact with its on-terminal at a time point $t_2$. At the key time assigned to this key from time point $t_1$ to time point $t_2$ in which the switch is in a neutral state immediately after the above keying, the on-signal NO and off-signal FO from exchanging circuit 80 are both "L" as described above and hence the outputs of inverters 342 and 343 become both "H".

On the other hand, when the closure force is released from the key, movable contact or pole of the switch moves away from its on-terminal at a time point $t_3$ and then contacts its off-terminal at a time $t_4$. At the key time assigned to the key between $t_3$ and $t_4$ where the switch is in a neutral condition, the on-signal NO and off-signal FO from exchanging circuit 80 are both turned to "L".

As shown in FIG. 25, the envelope is arranged to rise from the time point $t_2$ where the switch is completely turned on, fall slowly after its maximum value, attenuate with a certain time constant from the time point $t_4$ where the switch is completely turned off, and then become zero at a time point $t_5$. The signal EZ obtained from envelope addition circuit 160 is "H" at a time when the envelope is zero and "L" at the other time. That is, the signal EZ is "H" before the time point $t_2$ where the switch is completely turned on and after the time point $t_5$ where the switch is completely turned off, while "L" between the time points $t_2$ and $t_5$.

Accordingly, at the operation time of stress or loudness, where the output XV of enable decoder 100 is "H", in the key time or times assigned to the key between $t_1$ and $t_2$ where the switch is in its neutral condition immediately after keying, the write pulse or pulses WP is or are fed through AND gate 341 to count up the stress random access memory 330. The time period between $t_1$ and $t_2$ is changed according to the keying strength, or made shorter according as the key is attacked strong, so that the number of counting pulses fed to the memory 330 is changed according to keying strength, or increased according as the key is attacked weakly.

Even after the switch is completely returned to its off state at the time point $t_4$, it is required that various kinds of operation are carried out to generate sounds. However, when the switch is completely turned off at $t_4$, the off-signal OF from ON-OFF detecting circuit 70 becomes "H". Therefore, the signal EZ from envelope addition circuit 160 is fed to the exchanging circuit 80 so that the signal EZ is used instead of the off-signal OF after the time point $t_4$.

A description will next be given on a series of operations of the above described apparatus.

Prior to the performance, the adjustment or instrument selection section is set by the operator and supplies the 4-bit selecting signal respectively to the envelope data read-only memory 170, time spectrum decoder 180 and tone spectrum data read-only memory 360.

Upon attacking one or a plurality of keys, at the ON-OFF detecting circuit 70, the switch or switches corresponding to the attacked key or keys are turned on through each neutral condition. At the exchanging circuit 80 the keying is sequentially assigned to the key times of key 0, key 1, . . . for being detected, and the signal RP from reset pulses generating circuit 140 becomes "H", that is, the circuit 140 generates the reset pulse, which is applied to the main random access memory 110. As mentioned above, the reset pulse is obtained at the assigned key times of all the row times from row 0 to row 15 in the first group time. During the above times, the output MA of matrix decoder 90 is applied to the memory 110 to address all its words of the block corresponding to the keys so that the content of all words of block memory 110 corresponding to the keys is cleared by the reset pulse.

The operation or generation of a partial sine wave is carried out in the following manner. At the operation time of a sine wave in the 16-row and 8-column matrix time-table, the output XM of enable decoder 100 is "H", while its output XE is "L", and hence the output of inverter 151 is "H" to make the output of AND gate 152 "H". As a result, the unit data used for the calculation of a sine wave is read out from the words of sine wave of main data read-only memory 150. This unit data is fed through the digital adding circuit 220 to the latch circuit 210 where it is latched by the latch pulse LP. With the output XM being "H", the write pulse WP is fed through AND gate 111 to main random access memory 110 so that the latched unit data is written in the words of sine wave of the memory 110.

At the next operation time of the same sine wavecomponent, the unit data of sine wave is read out from the memory 150. Meanwhile, since the output XM of enable decoder 100 is "H", the operation data of sine wave is read out from the memory 110. Thus, both of the above data are applied to the adding circuit 220 where they are added together and thus added data is written in the main random access memory 110.

The generation of sine wave is thus performed by using the words of sine wave of the memory 110 as mentioned above.

The sine wave components of the total signal to be generated consist of a respective fundamental harmonic components and subharmonic components. Unit data of the respective sine wave components are stored in different words at the main data read-only memory 150. These unit data are read out by the output MA of matrix decoder 90 at respective operation times in a time-sharing manner. The main random access memory 110 also includes different words for the generation of respective sine wave components of the total signal to be generated and these words are addressed by the output MA of matrix decoder 90. Therefore, the generation of respective sine wave components is carried out using different words of memory 110 according to respective operation or output frequencies in a time-sharing manner.

Since the unit data of each sine wave component stored in the memory 150 corresponds to a phase angle at each operation period, each occasional operation data of each sine wave component obtained from the memory 110 becomes equal to the unit phase angle integrated according to the operation frequency. For example, when the key has a fundamental frequency of 200 Hz, the operation data of first harmonic wave is changed as shown by $\theta_1$ in FIG. 2, that of second harmonic wave as shown by $\theta_2$, and that of third harmonic wave as shown by $\theta_3$, respectively.

The generation of noise is performed in the following manner. At the operation time of noise in the matrix time table, the output XM of enable decoder 100 is "H" and the output XE thereof is "L", so that similarly as the generation of a sine wave the unit data used for the generation of noise from the memory 150 is sequentially added by the words of noise of the memory 110. Similarly, the operation data becomes equal to integrated unit phase angle.

The operation of time lapse will next be described. At the operation time of time lapse in the matrix time table, since the output XM of enable decoder 100 is "H" and the output XE thereof is "L", the unit data of time lapse from the memory 150 is similarly added sequentially by the words of time lapse of the memory 110. Accordingly, the operation data indicates time lapse from the instant of keying and increases as the time elapses.

Then, at the operation time of time lapse, when the output XT of enable decoder 100 becomes "H", the write pulse WP is applied through an AND gate 201 to the time count random access memory 200 so that the operation data of time lapse from the memory 110 is temporarily stored in the memory 200.

Next, the operation of enevelope will be carried out by the following manner. At the operation time of envelope in the matrix time table, the output XE of enable decoder 100 is "H" and the output of AND gate 152 is "L" so that data is not read out from the main data read-only memory 150. Since the output XE is "H", gradient data for the operation of envelope is read out from the envelope data read-only memory 170. Also, signal XM from the enable decoder 100 is "H" so that the operation of envelope is performed by the words of envelope of memory 110. The operation data is adapted to represent each occasional amplitude of envelope.

Then, at the operation time of envelope, since the output XE of enable decoder 100 becomes "H", the write pulse WP is supplied through an AND gate 321 to the envelope random access memory 320 to temporarily store therein the operation data of envelope from the memory 110. While, when the output XE is "H" and an output of an OR gate 322 becomes "H", the stored operation data of envelope is read out.

Figure 26:
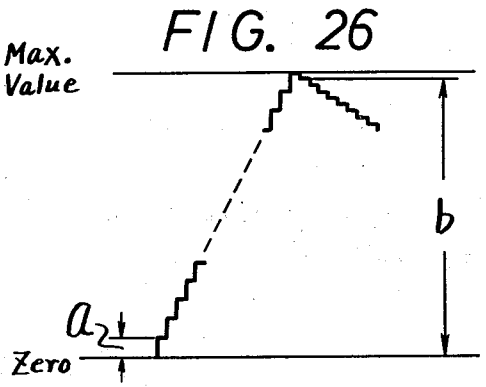

The operation data from memory 320 is supplied to the envelope addition circuit 160 to produce the signal EZ indicating whether the envelope is zero or not and the signal EU indicating whether the envelope is in the rising step or falling step as described above. This signal EU is fed to the envelope data read-only memory 170 together with the operation data of upper three bits from the memory 320 thereby to address the words of memory 170. As shown in FIG. 26, when the envelope is in the rising mode, a relatively small gradient data a is read out so that data is added up. When the envelope is in the falling mode, a large gradient data b approximating to the maximum value is read out so that data is attenuated. In this case, grade data is selected according to a step to which each occasional amplitude of envelope corresponds thereby to form the envelope as shown in FIG. 25.

The operation of stress or loudness is performed at the operation time of stress in the matrix time table. Since the output XM of enable decoder 100 is "H" and the output XE thereof is "L", the unit data for the operation of stress from the memory 150 is successively added to the words of stress of the memory 110. Accordingly, the operation data is increased according to time passage.

Then, during an interval where the switch is in a neutral condition immediately after its keying, the stress random access memory 330 is supplied with counted pulses so that the operation data from the memory 110 is repeatedly added to the memory 330. As a result, the number of counted pulses is changed according to the strength of keying, that is, increased as the keying is carried out weakly, so that data written in the memory 330 is similarly changed according to the strength of keying, that is, increased as the keying is carried out weakly.

In this case, as described with reference to the graph of FIG. 25, during an interval where the pole of the switch is in neutral condition at the end of keying, the envelope is not yet zero and the signal EZ is "L", so that it is impossible during the above interval that counter pulses are supplied to the memory 330 to rewrite the data thereof.

The operation of time spectrum will be now described. At the operation time of time spectrum, that is, at respective times of column 0 of row 9, row 11, row 13, row 15 in each of group 0, group 1, . . . , group 7, the output XP of enable decoder 100 becomes "H" so that the unit data for the operation of time spectrum is read out from the time spectrum data read-only memory 190. This unit data is supplied through the attenuator 230 and further through the digital adding circuit 220 to the latch circuit 210 where it is latched therein by the latch pulse LP. While, the output XP is "H" and so the write pulse WP is supplied through an AND gate 131 to the time spectrum random access memory 130, so that the latched unit data is written in the memory 130.

In this case, the words of memory 190 are addressed by the signal MB for discriminating the times of row 9, row 11, row 13, row 15 of group 0, group 1, . . . , group 7. Meanwhile, since the output XM of enable decoder 100 becomes "L", the switch circuit 120 is changed over to the 8-terminal to derive therefrom the same signal MB which is adapted to address the words of memory 130. As a result, at the times of row 9, row 11, row 13, row 15 of group 0, group 1, . . . , group 7, different data for respective harmonic waves, subharmonic waves, nonharmonic components and noise are read out from different words of the memory 190 and written into different words for respective harmonic waves, subharmonic waves, nonharmonic components and noise of the memory 130.

At the operation time of time spectrum in the next cycle time, the unit data is similarly read out from the time spectrum data read-only memory 190 and thus read-out data is supplied through attenuator 230 to the digital adding circuit 220. Meanwhile, the output XP of enable decoder 100 is "H" and an output of an OR gate 132 is "H", so that the operation data is read out from the memory 130 and thus read-out data is supplied through the attenuator 240 to the digital adding circuit 220, where both of above-mentioned data are added to each other and thus added data is written in the memory 130.

As mentioned above, at different words of the memory 130 the operation of time spectrum for respective harmonic waves, subharmonic waves, nonharmonic components and noise is carried out with respect to time.

Figure 23:
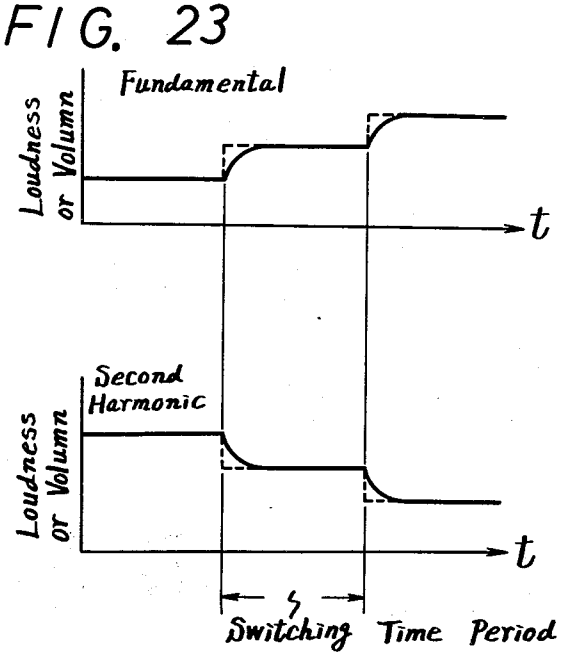

Then, the operation data of time lapse obtained from the time count random access memory 200 is supplied to the time spectrum decoder 180 to change the output of decoder 180, or the address signal of block of the memory 190 according to time lapse so that data read-out from memory 190 according to time lapse is selected. Thus, the strength of spectrum is changed as defined relating to respective harmonic waves, subharmonic waves, nonharmonic components and noise in such a manner that it is gradually increased relative to first harmonic wave and gradually decreased relative to third harmonic wave when the fundamental frequency of the key is, for example, 200 Hz at a quite longer changing-over period than the cycle time as shown in FIG. 23.

In this case, the operation data of time lapse from the memory 200 is suplied to the time count decoder 250 to produce a signal for discriminating the first cycle time immediately after keying from the following time. This signal is fed to the attenuators 230 and 240. Thus, at the first cycle time immediately after keying, the attenuator 230 has derived therefrom data from the memory 190 as it is, while the attenuator 240 has derived therefrom data from the memory 130 which is attenuated to zero with the result that the operation data of memory 130 is added with the data from memory 190 at that time thereby to increase sharply. At the time following the first cycle time, the attenuator 230 has derived therefrom the data from memory 190 which is attenuated to $\frac{1}{8}$, while the attenuator 240 has derived therefrom the data from memory 130 which is attenuated to $\frac{7}{8}$. As a result, the strength of spectrum is changed gently as shown by solid lines in FIG. 23 without being changed rapidly as shown by broken lines.

The timing pulse generating circuit 20 generates five adding pulses $A_1, A_2, \ldots, A_5$ within a column time (a fundamental operation time). These pulses are successively shifted in time from each other so that they are obtained in an order of $A_1, A_2, \ldots, A_5$. The unit 370 is a digital adder and accumulator. At the start of each column time the accumulator 370 is zeroed. All data fed into the adder accumulator 370 is in logarithmic form.

At the operation time of each sine wave component or noise, if the output XW of enable decoder 100 firstly becomes "H", the pulse $A_1$ is supplied through an AND gate 323 and an OR gate 322 to the envelope random access memory 320 to read-out therefrom the data indicating each occasional amplitude of envelope stored at the operation time of envelope. Thus read-out data is applied to the digital adding circuit 370.

At the operation time of each sine wave component or noise, if the output XW of enable decoder 100 secondly becomes "H", the pulse $A_2$ is supplied through an AND gate 351 to the stress or loudness read-only memory 350 to read-out therefrom the data of stress, which is addressed by the operation data from memory 330 written during an interval where the switch is in the neutral condition immediately after keying and determined by this operation data. Thus, volume read-out data is supplied to the digital adding circuit 370 and is added to the envelope information supplied by pulse $A_1$.

The data of stress read-out from the memory 350 becomes large that much when the operation data from the memory 330 is small due to strong keying.

At the operation time of each sine wave component or noise, if the output XW of enable decoder 100 thirdly becomes "H", the pulse $A_3$ is supplied through an AND gate 133 and an OR gate 132 to the time spectrum random access memory 130 to read-out therefrom the operation data of time spectrum, which is supplied to the digital adding circuit and is added to the envelope and stress or volume information supplied by pulses $A_1$, $A_2$.

At the operation time of each sine wave component or noise, if the output XM of enable decoder 100 becomes "H" the switch circuit 120 is changed over to the A-terminal as illustrated to derive therefrom the output MA of matrix decoder 90, which is adapted to address the words of memory 130. Therefore, as apparent from FIG. 14, at the operation time of first harmonic wave there is read out the data indicating the strength of spectrum at that time for the first harmonic wave, at the operation time of second harmonic wave there is read out the data indicating the strength of spectrum at that time for the second harmonic wave, and so on. As mentioned above, read out at the operation times of respective sine wave components and noise are data indicating the strengths of spectra at those times for the respective sine wave components and noise.

At the operation time of each sine wave component or noise, if the output XW of enable decoder 100 fourthly becomes "H", the pulse $A_4$ is supplied through an AND gate 361 to the tone spectrum data read-only memory 360 to read-out therefrom the data indicating the strength of spectrum determining tones. This data is supplied to the digital adding circuit 370 and is added to the envelope, volume, and time spectrum information previously supplied by pulses $A_1$, $A_2$ and $A_3$.

In this case, since the words of memory 360 are addressed by the output MA of matrix decoder 90, read-out at the operation times of respective sine wave components and noise are the data indicating the strength of spectra for the respective sine wave components and noise.

Then, at the operation time of each sine wave component, if the output XS of enable decoder 100 fifthly becomes "H", the pulse $A_5$ is fed through an AND gate 301 to the sine wave read-only memory 300 to read-out therefrom the data indicating the peak values of sine wave memory 300 is addressed by data from main ram 110 which corresponds to the current sine wave component to be generated specified by the matrix decoder 90. This read-out data is fed to the digital adding circuit 370. Alternately, at the operation time of noise, if the output XN of enable decoder 100 fifthly becomes "H", the pulse $A_5$ is supplied through an AND gate 311 to the noise read-only memory 310 to read-out therefrom the data indicating the peak values of noise which is addressed by each occasional operation data of noise and determined by this operation data. This read-out data is supplied to the digital adding circuit 370 and is added to the information previously supplied by pulses $A_1$–$A_4$.

Occasional operation data of respective sine wave components from the memory 110 are formed by integrating unit phase angles of respective sine wave components. These data of integrated phase angles are supplied as addresses to the memory 300 to address the data stored therein and indicating the peak values at 256 sampling points of a sine wave within one period. Therefore, the data of peak values read-out from the memory 300 at the operation times of respective sine wave components will reproduce the waveforms of the respective sine wave components. Similarly, the data of peak values read-out from the memory 310 at the operation time of noise will reproduce the waveform of the noise. Only one ROM 300 is needed to store amplitude values of a sine wave no matter what the desired output frequencies are, as the values stored in ROM 300 are read out at varying rates.

As described above, in the digital adding circuit 370, at every operation time of each sine wave component or noise (corresponding to each column time) there are sequentially added logarithmic data indicating corresponding amplitude of envelope, logarithmic data of stress, logarithmic data indicating the strength of each occasional spectrum for ech sine wave component or noise, logarithmic data of the strength of spectrum for each sine wave component or noise determining the tone, and logarithmic data of peak values of each sine wave component or noise including its bias. The summed data is fed, each column time, to the inverse logarithm decoder 380 where it is returned to linear scale and also the bias for the peak values of each sine wave component or noise is removed to obtain the multiplied one of data indicating the occasional magnitude of envelope, data of stress, data indicating the strength of each occasional spectrum for each sine wave component or noise, data of the strength of spectrum for each sine wave component or noise determining the tone, and data of peak values of each sine wave component or noise.

This multiplied data is fed to the digital-to-analog converter 390 to be converted into an analog signal, which is then fed to the analog switch 400.

The analog switch 400 is applied with the band discriminating signal read out from the main data read-only memory 150 as its change-over signal. The band discriminating signal serves to discriminate one band from the separated five bands which corresponds to the frequency of waveform itself of each sine wave component and noise or operation frequency thereof. The memory 150 is addressed by the output MA of decoder 90 to read out therefrom the band discriminating signal corresponding to each sine wave component or noise at the operation time of the sine wave component or noise. The band discriminating signal acts to distribute the multiplied signal from the converter 390 at the operation times of respective sine wave components and noise to five output ends of the analog switch 400 to derive therefrom five signals. These distributed output signals are fed to the low-pass filters 410 to 450 having respective upper cut-off frequencies, each of which corresponds to the band of frequency of the waveform itself or operation frequency as shown in FIG. 19. Output signals of these low-pass filters 410 to 450 are added together at the analog adding circuit 460 and the thus added signal is fed to the speaker 470.

As described above, the sound corresponding to an attacked key is reproduced by a certain envelope with a strength corresponding to the keying strength.

In the above examples, the assignment of each element at the matrix time table can be carried out in any manner provided that the operation or output frequencies for respective sine wave components and noise are selected to exceed the sampling frequencies to be required. In the illustrated examples, the number of operation assignments to the respective sine wave components and noise at the matrix time table is selected in a relation such as two times, four times, eight times and 16 times, but it is also possible to select the same in a relation such as two times, three times, four times, six times, and so on. Further, elements other than those shown in FIGS. 4 and 5 can also be assigned.

The numbers of group, row, key and column in the matrix time table can also be freely selected. For example, it is possible to make the key time short, that is, the number of keys in one row is increased so that the number of sounds which can be simultaneously generated is increased, or the key time can be made long and hence the number of columns in one key is increased so that the number of sounds which can be simultaneously generated is decreased and higher-order harmonics are assigned. It is also possible that the length of key time and hence the number of columns in one key can be changed according to sound range. In some cases, the key time can be made equal to the column time and instead the number of rows in one group is increased.

Referring to the circuit arrangement, the time count random access memory 200, envelope random access memory 320 and stress random access memory 330, which are all buffer random access memories for temporary storage, can be integrated. If the main random access memory 110 is of high speed, the above buffer random access memories can be neglected. If the main random access memory 110 is of high speed, the time spectrum random access memory 130 can also be integrated with the memory 110 to read out therefrom data in a time-sharing manner. The main data read-only memory 150, envelope data read-only memory 170 and time spectrum data read-only memory 190 can also be integrated together. Further, if the cycle time, which is 6.4 msec. in the illustrated example, is shorter than the refresh time, the main random access memory 110 and time spectrum random access memory 130 can be of dynamic type.

The addition of data of each element at the operation time of each sine wave component or noise can be carried out at the order desirable for circuit. Further, instead of adding the data of each element sequentially at every operation time of each sine wave component or noise, data excepting the data of peak values of each sine wave component or noise can all be added at every cycle time and stored in a buffer random access memory. During the operation time of each sine wave component or noise the aforesaid data stored in the buffer random access memory can be added to the data of peak values of each sine wave component or noise, so that the number of additions can be reduced and the circuit can be made of high speed.

Further, it is posssible to eliminate the reproduction of keying strength or replace elements of envelope, time spectrum and tone spectrum by the element of time spectrum so that the circuit may be simplified. It is also possible to vary the unit data for the operation of each sine wave component or noise read-out from the main data read-only memory 150 with the lapse of time to apply vibrato or portamento.

According to this invention, the operation of partial waveform of each harmonic wave, subharmonic wave, nonharmonic component, noise or the like is carried out by the operation frequencies corresponding to the sampling frequencies required for each partial waveform, so that it is sufficient to store the peak values common to respective partial waveforms.

Only one set of peak values of sine wave, for example, need be stored for the purpose of generating all sine waves. Similarly, only one set of noise values need be stored.

The invention is also applicable to instruments where the stored waveshape is not sinusoidal but could include a saw-tooth type waveform whose peak value is stored over one cycle in ROM 300.

As a result, the capacity of memory can be made small and also the frequency of operations can be reduced, so that the construction is simplified even in the case of polyphonic system. Then, the operation outputs of peak values of each partial waveform are supplied to the low-pass filters, each having an upper cut-off frequency corresponding to each of the operation frequencies of the above outputs, and hence clock components of operation can be surely removed.

While various modifications or changes might be proposed by those skilled in the art, it will be understood that I wish to include within the scope of the claims warranted hereon all such modifications or changes as reasonably come within my contribution to the art.

I claim as my invention:

1. A waveform synthesizing apparatus comprising:

means for digitally storing a selected plurality of identifiers of previously selected harmonic and non-harmonic component waveforms of a selected analog output signal to be synthesized, some of said harmonic and non-harmonic identifier being stored in said means for digitally storing plural times corresponding to a selected rate at which an amplitude value for said corresponding component waveform is to be formed, means for digitally generating a plurality of addresses, one at a time in sequence, said means for generating is connected to said means for digitally storing and adapted to repetitively generate said plurality of addresses and to cause said means for digitally storing to read out at a predetermined rate, for a predetermined time interval and in a predetermined sequence each of the members of said plurality of identifiers of components, means for digitally sensing each said readout component identifier during a corresponding time interval and including means for calculating a corresponding amplitude value for each said respective harmonic and non-harmonic waveform component during said corresponding time interval, each said amplitude value is calculated at the rate corresponding to said number of times said corresponding component identifier is stored in said means for storing.

means for digitally combining during said corresponding time interval each said calculated amplitude value with a plurality of previously calculated and combined component amplitude values to form a digital value and means for simultaneously forming during said corresponding time interval an analog output signal based on said corresponding digital value.

2. The waveform synthesizer according to claim 1 wherein said means for simultaneously forming includes:

a plurality of low pass filter means operably connected in parallel with one another, means for selecting one member of said pliurality during each said corresponding time interval, and means for summing an analog output from each member of said plurality and for generating the analog output signal during each said corresponding time interval.

3. The apparatus according to claim 1, wherein said means for sensing and calculating includes:

means for storing a plurality of phase angle parameters, said means for storing a plurality of phase angle parameters is addressed by each said component identifier and is adapted to read out a corresponding phase angle parameter, and means for accumulating a sum of corresponding phase angle parameters, said means for accumulating is connected to an output of said means for storing a plurality of phase angle parameters and includes feedback means whereby a selected sum can be combined with a corresponding phase angle parameter to form a new sum.

4. The apparatus according to claim 3 wherein:

said means for digitally combining includes first means for read only storage, said first means is adapted to store sampled amplitude values over one period of a selected sine wave, said means for read only storage is adapted to be addressed during each said corresponding time interval by selected sums of corresponding phase angle parameters generated by said means for accumulating and to read out a corresponding sampled sine wave amplitude value in response thereto, said means for combining is adapted to add during each said corresponding time interval each said read out sine wave amplitude value to said previously calculated and combined component amplitude values thereby to form said digital value.

5. The apparatus according to claim 4 wherein:

said means for digitally storing a selected plurality of identifiers of previously selected harmonic and non-harmonic waveform components includes means for storing a selected plurality of identifiers of additional parameters of the analog output signal to be synthesized.

6. The apparatus according to claim 5 wherein:

said means for sensing and calculating is adapted to sense each member of said selected plurality of identifiers of additional parameters during a respective time interval and to calculate during said time interval a digital parameter value corresponding to one of a sensed envelope parameter, a stress parameter, a time lapse parameter or a time spectrum parameter.

7. The apparatus according to claim 6 including:

means responsive to each of a plurality of manually operable keys connected to said means for storing and wherein said means for storing includes:

matrix decoding means for storing adapted to store a selected plurality of identifiers of previously selected harmonic and non-harmonic component waveforms for each member of said plurality of keys and adapted to sense a selected depressed key and to generate a corresponding plurality of identifiers in response thereto.

8. A music synthesizer comprising:

a clock source adapted to continuously generate pulses at a selected rate;

a plurality of interconnected means for counting, said means for counting are adapted to respond to and count the pulses generated by said clock source;

matrix storage means adapted to be addressed by said means for counting to cyclically read out one at a time in sequence for a predetermined time interval a plurality of pre-selected identifiers of types of harmonic and non-harmonic waveform components as well as identifiers of a pre-selected plurality of additional parameters of an analog output wave to be synthesized some of said identifiers being stored plural times, whereby, said identifiers are read out at differing rates corresponding to differing predetermined sample rates for each corresponding component waveform;

means for accumulating a plurality of phase angle values, said means for accumulating is adapted to sense each said identifier type read out from said matrix storage means and at a rate corresponding to said rate at which each said type of identifier is read out to accumulate a corresponding phase angle value for each corresponding harmonic and non-harmonic waveform component, said means for accumulating includes means for feeding back a selected previously formed phase angle value accumulated during a prior corresponding time interval to be combined with a pre-selected and stored phase angle parameter to form an updated phase angle value;

means for storing a plurality of sampled amplitude values of a selected harmonic wave and a selected non-harmonic wave, said means for storing is adapted to be addressed by said accumulated phase angle values during corresponding time intervals and to read out corresponding harmonic or non-harmonic waveform amplitude values during each said time interval in response thereto;

said means for storing is connected to means for forming a corresponding analog signal, said means for forming is adapted to form an analog output signal during each said time interval.

9. The music synthesizer according to claim 8 wherein said means for forming includes:

means for analog switching connected to a plurality of low pass means for filtering, an output of each member of said plurality is connected to analog means for summing, an output from said means for summing is connected to means for converting an analog sum formed by said means for summing into an acoustic wave, said means for analog switching is adapted to select one member of said plurality during each said time interval.

10. The apparatus according to claim 8, wherein:

said means for accumulating is further adapted to accumulate during selected time intervals as determined by corresponding parameter identifiers read out from said matrix storage means analog output wave time spectrum or envelope parameter values.

11. The apparatus according to claim 10, wherein said means for storing includes:

additional means for storing intensity and tone spectrum parameters adapted to be read out during selected time intervals in response to corresponding parameter identifiers being read out by said matrix storage means.

12. A method of digital synthesis of a waveform comprising the steps of:

selecting a cycle time, dividing the cycle time into a selected number of time intervals, selecting a plurality of types of component waveforms to be combined together over one cycle to synthesize the desired waveform, said types comprising sinusoidal and non-sinusoidal waveforms, determining one or more time intervals during the cycle at which an amplitude value for each member of the plurality of types of component waveforms is to be formed, generating a digital signal to identify which member of the plurality of types of component waveforms is to be formed during each time interval of the cycle, sensing the digital signal and calculating at each time interval an amplitude value for the corresponding type of component waveform based on at least a selected set of parameters, and the sensed digital signal, combining during each time interval the amplitude values of each member of said plurality of types of component waveforms calculated during a plurality of prior time intervals with the amplitude value calculated during that time interval to form a digital representation of a part of the amplitude of the waveform to be synthesized during that time interval, and forming a synthesized analog signal corresponding to the digital representation during that time interval.

13. An electronic instrument comprising:

means for storing a list of identifiers of a selected plurality of types of waveforms, said types comprising sinusoidal and non-sinusoidal waveforms, said means for storing is adapted to read out all of said identifiers one at a time in sequence and during a predetermined time interval, means for calculating a digital amplitude of each said identified type of waveform during said time interval and at a selected rate as determined by said list of identifiers, and means for forming a synthesized output signal during each said time interval from said digital amplitude values.

14. A polyphonic musical instrument comprising:

a plurality of manually operable keys, means for sensing a plurality of simultaneously depressed keys, means for storing a list of identifiers of previously selected harmonic and non-harmonic waveforms, some of said identifiers being stored plural times, means connected to said sensing and storing means to calculate at a selected rate a digital amplitude for each identified type of waveform in said list, said rate is determined by the number of times each said identifier appears in said list, and means for forming a polyphonic synthesized output signal from said digital amplitude values and said plurality of depressed keys.

15. A method of synthesizing a desired waveform comprising the steps of:

storing a list of identifiers of harmonic and non-harmonic waveforms, some of said identifiers being stored plural times scanning the list at a selected rate, and digitally calculating during selected time intervals amplitude values of each harmonic or non-harmonic waveform at a rate proportional to the number of times that the corresponding waveform identifier appears in the list, and combining the calculated, digital, amplitude values to form the synthesized output signal.

16. The method according to claim 15 wherein each of the digitally calculated amplitude values is calculated as the logarithm of the desired amplitude value.

17. The method according to claim 16 including the further step of:

converting the logarithmic amplitude value to the actual amplitude value.

18. The method according to claim 17 wherein the step of combining includes adding together a plurality of logarithmic data values to form each amplitude value.

19. The method according to claim 18 wherein the logarithmic data values represent amplitude, intensity, tone, and envelope information.

20. A digital vaveform synthesizer for synthesizing a selected analog output wave comprising:

means for subdividing a cycle time into a selected number of equal length time intervals, means for storing and for associating with a selected plurality of said time intervals identifiers of a selected plurality of types of harmonic and non-harmonic waveforms, said types comprising sinusoidal and non-sinusoidal waveforms, means for calculating an amplitude segment of a said identified type of harmonic or non-harmonic waveform during each said associated time interval, said calculating taking place repeatedly during corresponding time intervals in successive cycles, means for combining each said amplitude segment calculated during a said time interval with a plurality of amplitudes calculated during a plurality of prior time intervals to form a digital representation of the selected analog signal and means for converting each said digital representation to an analog output wave during each said corresponding time interval.

21. The synthesizer according to claim 20 wherein:

said means for subdividing includes a plurality of series-connected means for counting.

22. The synthesizer according to claim 20 wherein:

said means for storing and for associating includes matrix decoding means adapted to sense each said time interval.

23. The synthesizer according to claim 20 wherein:

said means for calculating includes a read-write means for storage within a digital feedback loop as well as means for including envelope and time spectrum related information in selected ones of said calculations.

24. The synthesizer according to claim 23 wherein said means for combining includes:

read-only means for storage of sampled amplitude values of a selected waveform over one period, said selected waveform corresponds in envelope shape to the envelope shapes of selected ones of the identified types of waveforms stored in said means for storing and for associating.

25. The synthesizer according to claim 24 wherein said means for combining includes further:

read-only means for storage of sampled peak values of a selected noise waveform.

26. The synthesizer according to claim 25, wherein said means for combining includes further:

read-only means for storage of tone spectrum data.

27. A polyphonic digital waveform synthesizer comprising:

means subdividing a cycle time into a selected number of equal length time intervals, a plurality of manually operable means for keying, means sensing a plurality of simultaneously operated means for keying, means storing selected pluralities of identifiers of types of waveforms, there being a unique set of stored identifiers for each of said means for keying, said types comprising sinusoidal and non-sinusoidal waveforms, one stored plurality of identifiers is associated with each said means for keying, each stored identified waveform is associated with at least one time interval, means calculating components of amplitude segments, an amplitude segment for a selected identified type of waveform is calculated in said associated time interval or intervals based on the contents of said means for storing selected pluralties in response to said corresponding means for keying being operated, means combining the calculated components during each said time interval to form a digital representation of the analog signal to be output during each said time interval, and means converting said digital representation formed during each said time interval to a polyphonic analog signal corresponding to the simultaneously operated means for keying.

* * * * *